US012280287B1

(12) United States Patent
Chen

(10) Patent No.: US 12,280,287 B1
(45) Date of Patent: Apr. 22, 2025

(54) LOCKING MECHANISM FOR WEIGHT PLATE AND DUMBBELL USING SAME

(71) Applicant: Yongkang Jiebao Industry and Trade Co., Ltd, Zhejiang (CN)

(72) Inventor: Huiguan Chen, Zhejiang (CN)

( * ) Notice: Subject to any disclaimer, the term of this patent is extended or adjusted under 35 U.S.C. 154(b) by 0 days.

(21) Appl. No.: 18/438,394

(22) Filed: Feb. 9, 2024

(51) Int. Cl.
*A63B 21/072* (2006.01)
*A63B 21/075* (2006.01)

(52) U.S. Cl.
CPC ..... *A63B 21/0728* (2013.01); *A63B 21/0726* (2013.01); *A63B 21/075* (2013.01)

(58) Field of Classification Search
CPC . A63B 21/0728; A63B 21/0726; A63B 21/06; A63B 21/072–075
See application file for complete search history.

(56) References Cited

U.S. PATENT DOCUMENTS

2007/0167300 A1* 7/2007 Krull ..... A63B 21/075 482/107
2014/0349820 A1* 11/2014 Wang ..... A63B 21/0726 482/108
2016/0059064 A1* 3/2016 Smith ..... A63B 24/0062 482/5
2020/0398100 A1* 12/2020 Wang ..... A63B 21/0726
2021/0146186 A1* 5/2021 Chen ..... A63B 21/075
2023/0113430 A1* 4/2023 Chen ..... A63B 21/0726 482/107
2023/0264066 A1* 8/2023 Huang ..... A63B 21/075 482/107

* cited by examiner

*Primary Examiner* — Joshua Lee
*Assistant Examiner* — Catrina A Letterman
(74) *Attorney, Agent, or Firm* — Hawaii Patent Services; Nathaniel K. Fedde; Kenton N. Fedde

(57) ABSTRACT

A dumbbell comprises a dumbbell body and a weight plate set, wherein the weight plate set comprises a weight plate and a locking mechanism; the locking mechanism comprises an accommodating disk, a limiting device and a limiting disk; the limiting device comprises a limiting block and a transmission block; the limiting block has a locking position and a releasing position; a limiting rail groove is arranged on the limiting disk; the limiting rail groove has a locking section and an opening section; a locking notch is also arranged on the accommodating disk; and a locking part is arranged on the weight plate; when in use, the dumbbell body is rotated, and the dumbbell is used for training such as pushing, lifting, lifting and squatting.

17 Claims, 24 Drawing Sheets

| | 0.5kg | 1kg | 2kg | 4kg | 4kg | | 4kg | 4kg | 2kg | 1kg | 0.5kg |
|---|---|---|---|---|---|---|---|---|---|---|---|
| 2 | | | | | | | | | | | |
| 3 | O | | | | | | | | | | O |
| 4 | | O | | | | | | | | O | |
| 5 | O | O | | | | | | | | O | O |
| 6 | | | O | | | | | | O | | |
| 7 | O | | O | | | | | | O | | O |
| 8 | | O | O | | | | | | O | O | |
| 9 | O | O | O | | | | | | O | O | O |
| 10 | | | | | O | | O | | | | |
| 11 | O | | | | O | | O | | | | O |
| 12 | | O | | | O | | O | | | O | |
| 13 | O | O | | | O | | O | | | O | O |
| 14 | | | O | | O | | O | | O | | |
| 15 | O | | O | | O | | O | | O | | O |
| 16 | | O | O | | O | | O | | O | O | |
| 17 | O | O | O | | O | | O | | O | O | O |
| 18 | | | | O | O | | O | O | | | |
| 19 | O | | | O | O | | O | O | | | O |
| 20 | | O | | O | O | | O | O | | O | |
| 21 | O | O | | O | O | | O | O | | O | O |
| 22 | | | O | O | O | | O | O | O | | |
| 23 | O | | O | O | O | | O | O | O | | O |
| 24 | | O | O | O | O | | O | O | O | O | |
| 25 | O | O | O | O | O | | O | O | O | O | O |

FIG. 18

LOCKING MECHANISM FOR WEIGHT PLATE AND DUMBBELL USING SAME

TECHNICAL FIELD

The present invention relates to the technical field of fitness equipment, in particular to a locking mechanism for weight plates and a dumbbell using the same.

BACKGROUND

Dumbbell is a common simple equipment used to strengthen muscle strength training. When using dumbbell for fitness exercise, you can do various exercises such as pushing, lifting, lifting and squatting. Dumbbell training can exercise lower limb muscles, such as holding dumbbell and squatting with both feet. Long-term practice of dumbbells can modify muscle lines and increase muscle endurance. Regular practice of dumbbells with heavy weight can make muscles strong, strengthen muscle fibers and increase muscle strength. There are many benefits of using dumbbells to exercise regularly, which can not only exercise upper limb muscles and waist and abdomen muscles, but also make the body stronger and stronger. Therefore, more and more people like to use this kind of training equipment for exercise.

However, the connection structure between the weight plates of the traditional dumbbell is complicated, which is troublesome and prone to failure; and the span of each level of weight is large, so it is difficult and unfriendly for beginners to train. For example, a dumbbell disclosed in U.S. patent Ser. No. 15/730,738 has the problems of complicated connection structure and large weight span; similarly, the U.S. patent with application number of 17114400 also has some problems, such as complicated connection structure, inconvenient connection, easy failure, large weight span and unfriendly to novices.

Based on the above problems, it is necessary to put forward a new type of dumbbell, which has simple structure, convenient and quick connection, less failures, and can increase the weight with low weight, which is friendly to the users of fitness novices, providing users with better use experience and more friendly dumbbell selection for novices.

SUMMARY

The present invention provides a locking mechanism for weight plates, which includes an accommodating disk, wherein a limiting device and a limiting disk are arranged on the accommodating disk; and the limiting device comprises at least one limiting block and at least one transmission block, wherein the limiting block has a locking position and a releasing position driven by the transmission block; and a limiting rail groove is arranged on the limiting disk, and the limiting rail groove is provided with a locking section and an opening section; and the transmission block is slidably arranged in the limiting rail groove, at least one locking notch is also arranged on the accommodating disk, and the locking notch corresponds to the limiting block; and when the transmission block is located in the locking section, the limiting block is arranged in the locking notch, and when the transmission block is located in the opening section, the limiting block is far away from the locking notch.

The present invention provides a dumbbell, which includes a dumbbell body, wherein a plurality of weight plate sets are arranged on the dumbbell body; and the weight plate set comprises weight plates and a locking mechanism; and wherein, the locking mechanism comprises an accommodating disk, and a limiting device and a limiting disk are arranged on the accommodating disk; and the limiting device comprises at least one limiting block and at least one transmission block, wherein the limiting block has a locking position and a releasing position driven by the transmission block; and a limiting rail groove is arranged on the limiting disk, and the limiting rail groove is provided with a locking section and an opening section; the transmission block is slidably arranged in the limiting rail groove, at least one locking notch is also arranged on the accommodating disk, and the locking notch corresponds to the limiting block; and when the transmission block is located in the locking section, the limiting block is arranged in the locking notch, and when the transmission block is located in the opening section, the limiting block is far away from the locking notch; and wherein, at least one locking part is arranged on the weight plate, and the locking part corresponds to the locking notch; and when the limiting block is in the locking position, the limiting block is arranged in the locking part through the locking notch, and when the limiting block is in the releasing position, the limiting block is far away from the locking part.

The present invention also provides a locking mechanism for a weight plate; the locking mechanism includes an accommodating disk, and a limiting device and a limiting disk are arranged on the accommodating disk;

the limiting device includes at least one limiting block and at least one transmission block, wherein the limiting block has a locking position and a releasing position driven by the transmission block;

a limiting rail groove is arranged on the limiting disk, the limiting rail groove is provided with a locking section and an opening section, and the transmission block is slidably arranged in the limiting rail groove, wherein at least one locking notch is also arranged on the accommodating disk, and the locking notch corresponds to the limiting block;

when the transmission block is located in the locking section, the limiting block is arranged in the locking notch, and when the transmission block is located in the opening section, the limiting block is far away from the locking notch;

wherein, the accommodating disk is provided with at least one first accommodating groove and at least one fifth accommodating groove; the first accommodating groove is configured to accommodate the limiting device, and the fifth accommodating groove is configured to accommodate the weight plate.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

FIG. 18 is a weight table.

In the figures:

Figure 1:
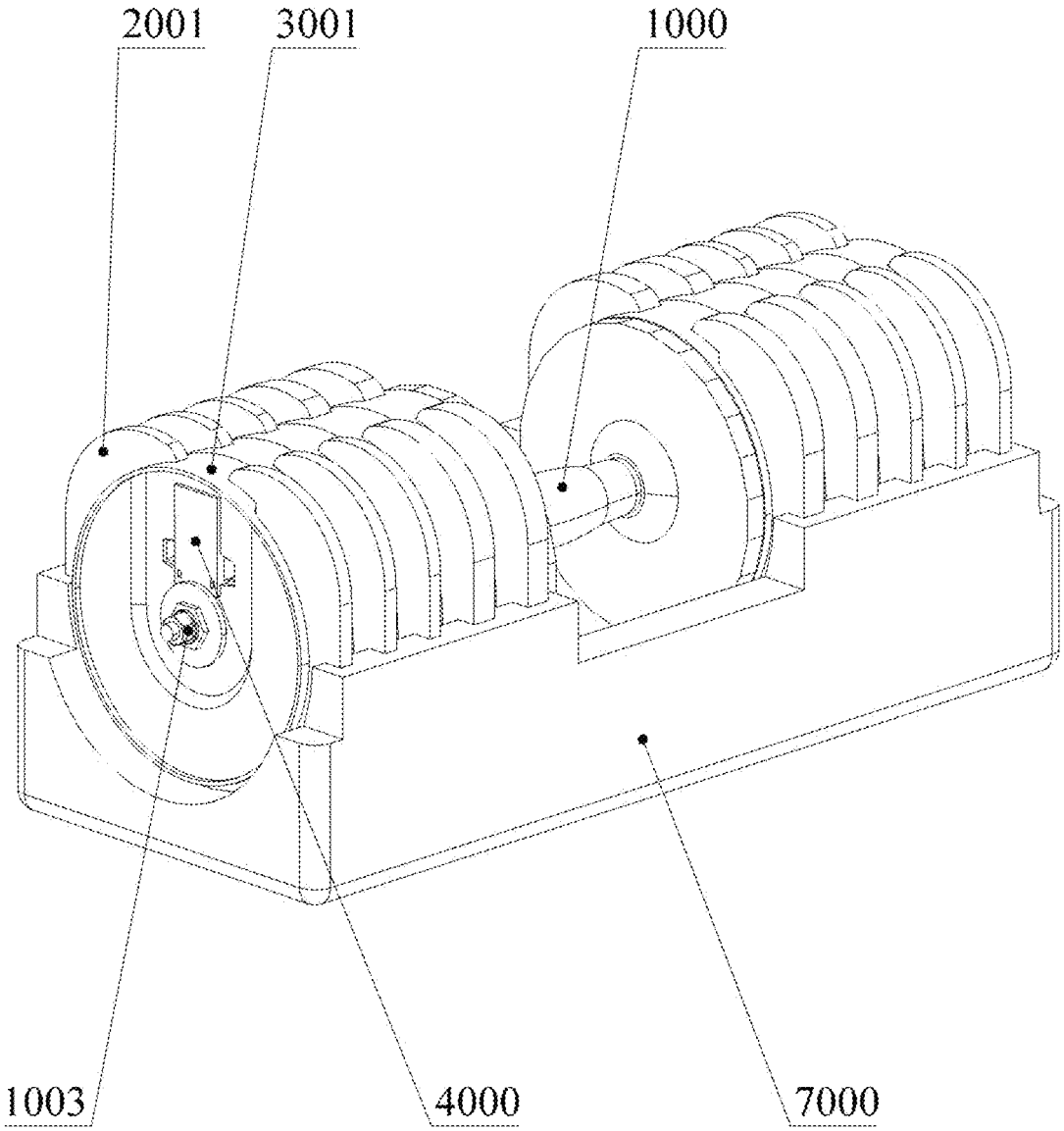
FIG. 1 is a schematic diagram of a dumbbell.
Figure 2:
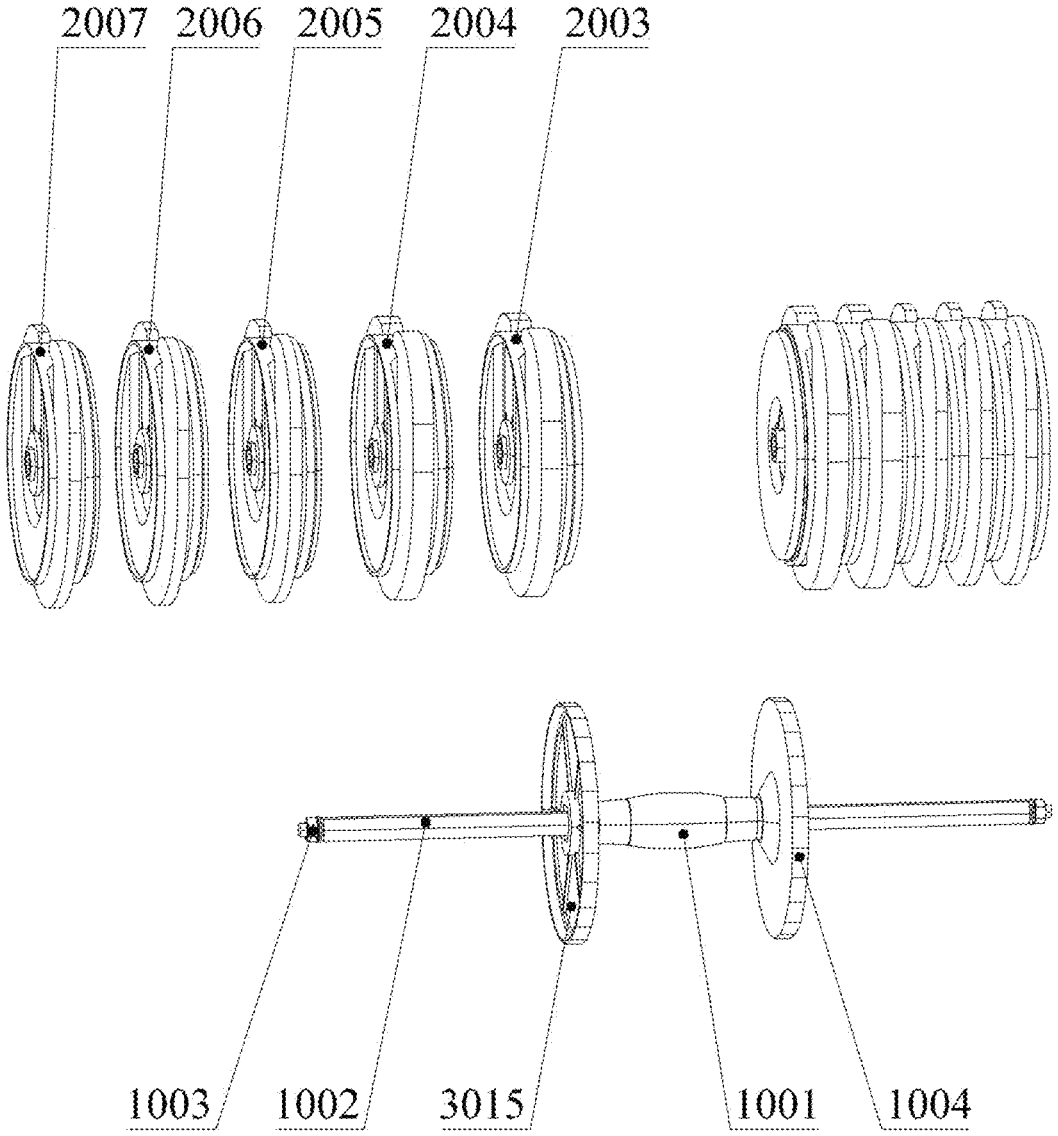
FIG. 2 is an exploded view of a dumbbell.
Figure 3:
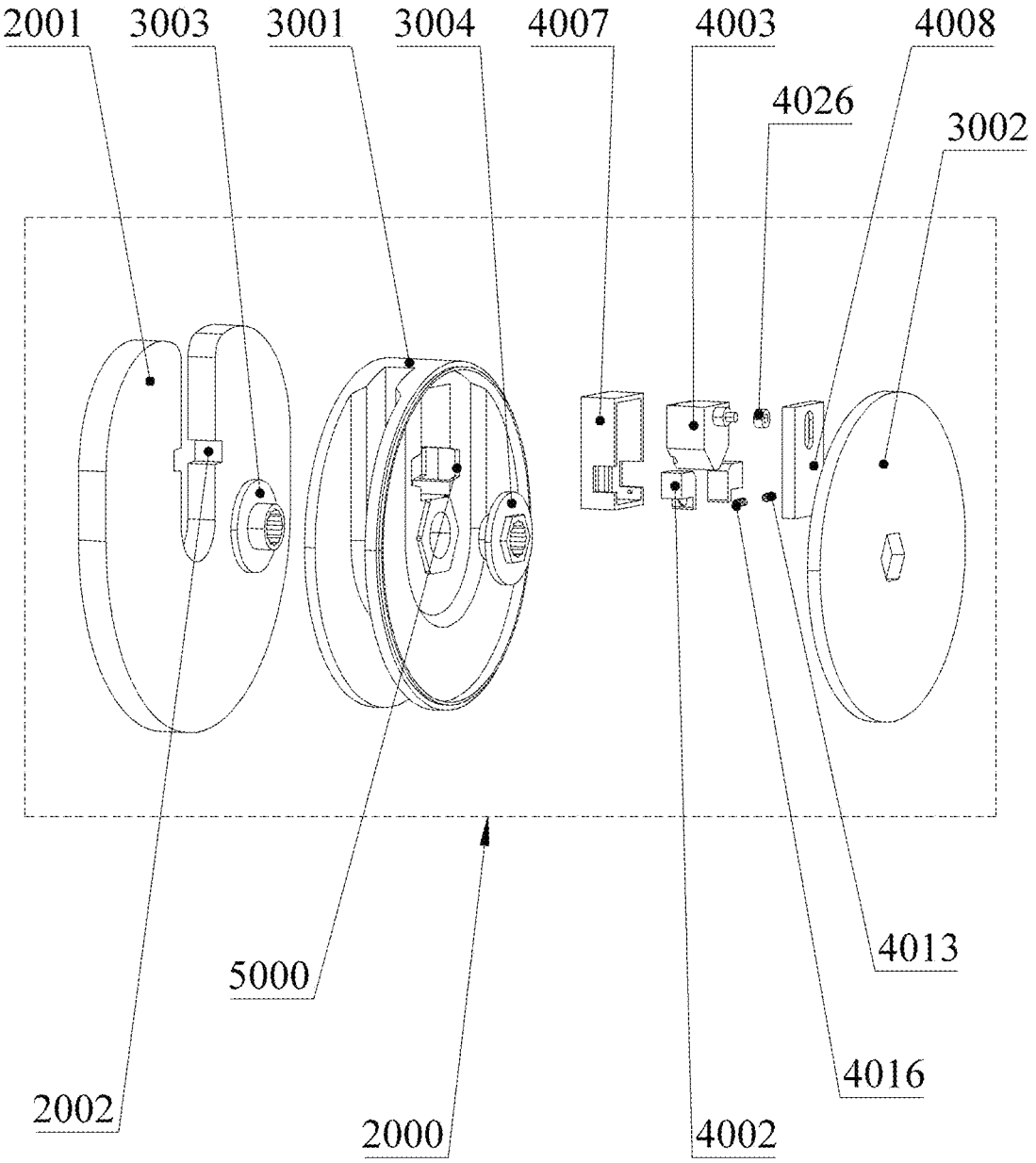
FIG. 3 is an exploded view of the weight plate set.
Figure 4:
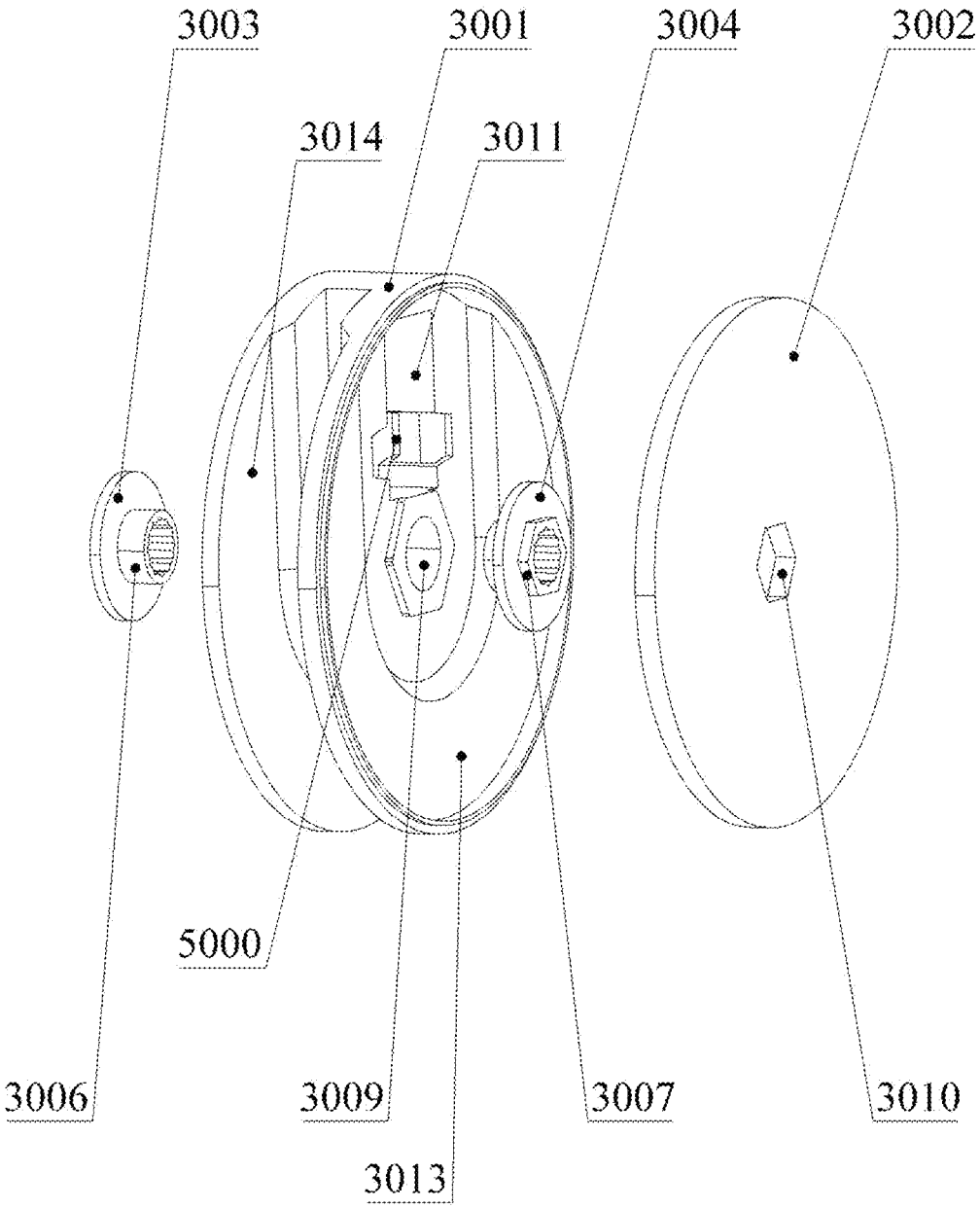
FIG. 4 is a partial schematic view of FIG. 3.
Figure 5:
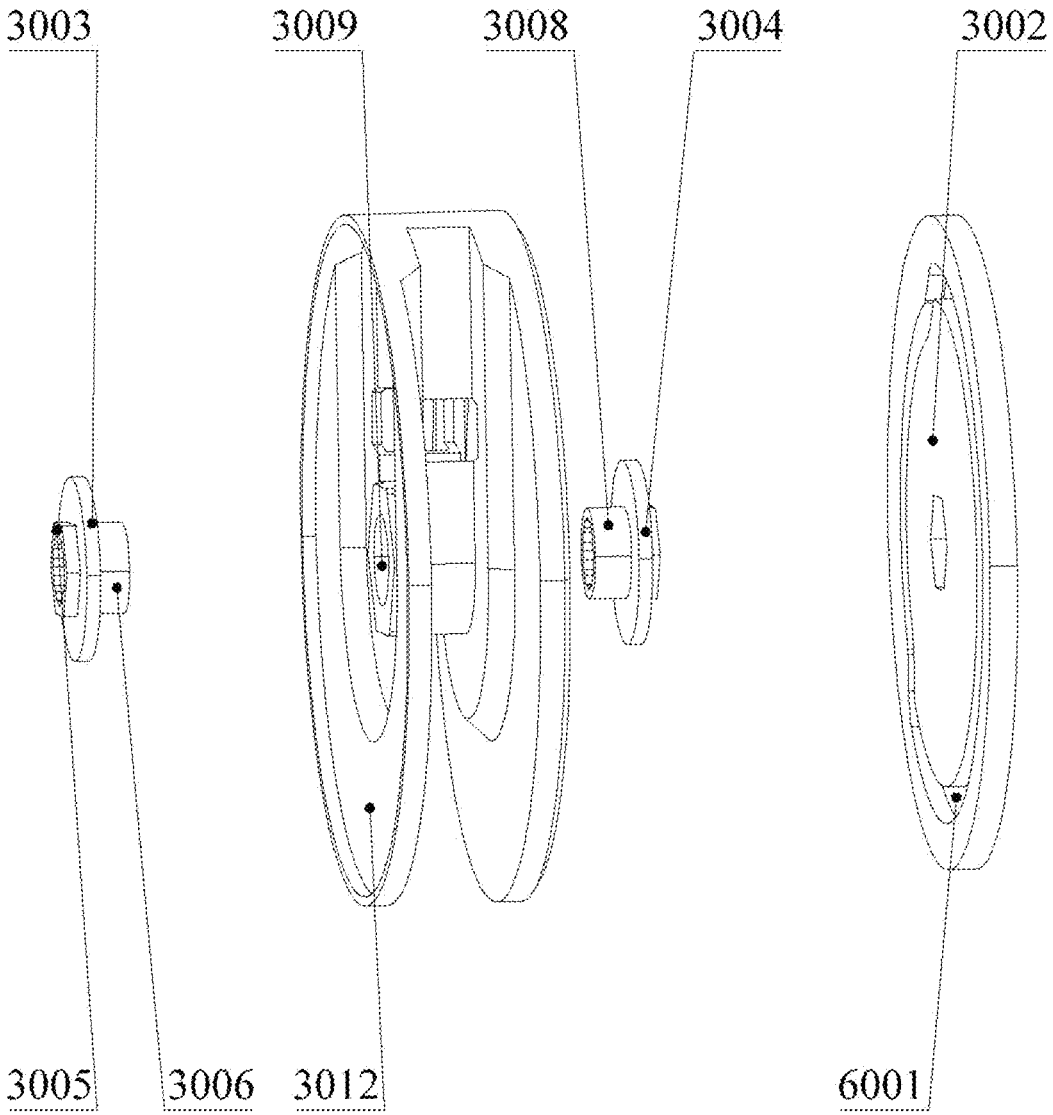
FIG. 5 is another schematic view of FIG. 4.

Dumbbell body (1000); Handle part (1001); Driving rod (1002); Fixing bolt (1003); Handle disk (1004); Weight plate set (2000); Weight plate (2001); Locking part (2002); First-level weight plate set (2003); Second-level weight plate set (2004); Third-level weight plate set (2005); Fourth-level weight plate set (2006); Fifth-level weight plate set (2007); Clamping part (2008); Configuration part (2009); Locking mechanism (3000); Accommodating disk (3001); Limiting disk (3002); First sleeve ring (3003); Second sleeve ring (3004); First rotating part (3005); First stationary part (3006); Second rotating part (3007); Second stationary part (3008); Stationary through hole (3009); Rotating through hole (3010); First accommodating groove (3011); Second accommodating groove (3012); Third accommodating groove (3013); Fifth accommodating groove (3014); Sixth accommodating groove (3015); First locking notch (3016); Second locking notch (3017); Limiting device (4000); Limiting chamber (4001); Limiting block (4002); Transmission block (4003); Abutting block (4004); Limiting opening (4005); Abutting opening (4006); Limiting shell (4007); Limiting cover (4008); First limiting block (4009); Second limiting block (4010); First limiting opening (4011); Second limiting opening (4012); First elastic part (4013); First positioning post (4014); First positioning groove (4015); Second elastic part (4016); Second positioning post (4017); Second positioning groove (4018); Positioning strip (4019); Sliding groove (4020); First thrust inclined plane (4021); Second thrust inclined plane (4022); First receiving inclined plane (4023); Second receiving inclined plane (4024); Abutting roller (4026); First viewing port (4027); Second viewing port (4028); Locking notch (5000); Limiting rail groove (6001); Locking block (6002); Opening block (6003); Base (7000); Base groove (7001); Unlocking block (7002); Second locking mechanism (7003); Locking shell (7004); Second locking block (7005); Third elastic part (7006); Third positioning post (7007); Third positioning groove (7008); Locking groove (7009); Locking opening (7010); Locking projection (7011); Locking tooth (7012); First connecting edge (7013); First boss (7014); First fixing hole (7015); Second connecting edge (7016); First groove (7017); Second fixing hole (7018); First slope (7019); Third viewing port (7020); First combined accommodating disk (8001); Second combined accommodating disk (8002); First combined limiting disk (8003); Second combined limiting disk (8004); First end face (8005); Second end face (8006); Third end face (8007); Fourth end face (8008); First fixing part (8009); Second retention part (8010); Third retention part (8011); First fixing buckle (8012); Second fixing buckle (8013); Third fixing buckle (8014); Cover plate (8015); Gear part (8016); Gear ring part (8017); Gear accommodating groove (8018); Fourth elastic member (8019); Gear fixture block (8020); Gear groove (8021).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

As shown in FIGS. 1 to 16, a dumbbell body 1000 provided by the present invention is provided with a plurality of weight plate sets 2000; the weight plate set 2000 includes a weight plate 2001 and a locking mechanism 3000;

- the locking mechanism 3000 includes an accommodating disk 3001, on which a limiting device 4000 and a limiting disk 3002 are arranged;
- the limiting device 4000 includes at least one limiting block 4002 and at least one transmission block 4003, wherein the limiting block 4002 has a locking position and a releasing position driven by the transmission block 4003;
- the limiting disk 3002 is provided with a limiting rail groove 6001, which has a locking section and an opening section, and the transmission block 4003 is slidably arranged in the limiting rail groove 6001, wherein the accommodating disk 3001 is also provided with at least one locking notch 5000, and the locking notch 5000 corresponds to the limiting block 4002;
- when the transmission block 4003 is located in the locking section, the limiting block 4002 is arranged in the locking notch 5000, and when the transmission block 4003 is located in the opening section, the limiting block 4002 is far away from the locking notch 5000;
- the weight plate 2001 is provided with at least one locking part 2002 corresponding to the locking notch 5000.
- when the limiting block 4002 is in the locking position, the limiting block 4002 is arranged in the locking part 2002 through the locking notch 5000, and when the limiting block 4002 is in the releasing position, the limiting block 4002 is far away from the locking part 2002.

In this embodiment, the locking notch 5000 is set as a substantially U-shaped through groove, and the locking part 2002 is set as a substantially U-shaped blind groove, wherein the limiting block 4002 passes through the locking notch 5000 and is arranged in the locking part 2002. In other embodiments (not shown in the figure), the locking notch and locking part are not limited to being roughly U-shaped, but also can be square, round, oval and any desired geometric shape.

As shown in FIGS. 1 to 17, in this embodiment, the dumbbell body 1000 includes a handle part 1001, and weight plate sets 2000 are symmetrically arranged at both ends of the handle part 1001, wherein the weight plate sets 2000 are arranged as a first-level weight plate set 2003, a second-level weight plate set 2004, a third-level weight plate set 2005 and a fourth-level weight plate set 2006 from near to far relative to the handle part 1001; wherein, the limiting rail grooves 6001 in different weight plate sets 2000 have different numbers and proportions of locking blocks 6002 and opening blocks 6003.

Specifically, in the first-level weight plate set 2003, the weight of the weight plate 2001 is 4 kg, and the limiting rail groove 6001 has a locking block 6002 with an arc angle of about 225 degrees and an opening block 6003 with an arc angle of about 115 degrees.

In the second-level weight plate set 2004, the weight of the weight plate 2001 is 4 kg, and the limiting rail groove 6001 has a locking block 6002 with an arc angle of about 105 and an opening block 6003 with an arc angle of about 230.

In the third-level weight plate set 2005, the weight of the weight plate 2001 is 2 kg, and the limiting rail groove 6001 has three locking blocks 6002 and three opening blocks 6003 with equal angles, and the locking blocks 6002 and the opening blocks 6003 are arranged in a staggered manner.

In the fourth-level weight plate set 2006, the weight of the weight plate 2001 is 1 kg, and the limiting rail groove 6001 has six locking blocks 6002 and six opening blocks 6003 with equal angles, and the locking blocks 6002 and the opening blocks 6003 are arranged in a staggered manner.

In the fifth-level weight plate set 2007, the weight of the weight plate 2001 is 0.5 kg, and the limiting rail groove 6001 has 12 locking blocks 6002 with equal angles and 12 opening blocks 6003 with equal angles, and the locking blocks 6002 and the opening blocks 6003 are arranged in a staggered manner.

As shown in FIG. 18, the first column 2-25 is KG, that is, a different weight corresponding to each rotation of the handle. Each line corresponding to each different weight is a specific selection situation of the weight plate. If "O" is marked, it means being selected, and the space means not being selected. In other embodiments (not shown in the figure), the weighting scheme of the weight plate and the number and angle of the limiting rail grooves are not limited to the above, but can also be set to any desired weight of the weight plate and any desired number and angle of locking blocks and opening blocks.

As shown in FIGS. 2 to 5, in this embodiment, the dumbbell body 1000 includes a driving rod 1002, which passes through the handle part 1001 and rotates synchronously with the handle part 1001. The locking mechanism 3000 includes a first sleeve ring 3003 and a second sleeve ring 3004 sleeved on the driving rod 1002, which are synchronized with the driving rod 1002. The first sleeve ring 3003 is provided with a first rotating part 3005 and a first stationary part 3006, and the second sleeve ring 3004 is provided with a second rotating part 3007 and a second stationary part 3008.

In this embodiment, the driving rod 1002 is a hexagonal rod, and fixing bolts 1003 are arranged at both ends of the driving rod 1002, and the fixing bolts 1003 are used for fixing each weight plate set 2000 mounted on the dumbbell body 1000. In other embodiments (not shown in the figure), the driving rod is not limited to being a hexagonal rod, but can also be a triangular rod, a quadrilateral rod, a pentagonal rod, a heptagonal rod and any other rod with a desired shape.

In this embodiment, fixing bolts 1003 are provided at both ends of the driving rod 1002, and each weight plate set 2000 mounted on the dumbbell body 1000 is fixed by the fixing bolts 1003. In other embodiments (not shown in the figure), the two ends of the driving rod are not limited to being provided with fixing bolts, but also can be set as screws, rivets, pins, buckles and other arbitrary connection methods.

As shown in FIGS. 2 to 5, in this embodiment, the accommodating disk 3001 is provided with a stationary through hole 3009, and the accommodating disk 3001 is arranged on the first stationary part 3006 and the second stationary part 3008 through the stationary through hole 3009; the limiting disk 3002 is provided with a rotating through hole 3010, and the limiting disk 3002 is arranged on the second rotating part 3007 and the first rotation of the adjacent weight plate set 2000 through the rotating through hole 3010; when the dumbbell body 1000 rotates, the accommodating disk 3001 is stationary relative to the dumbbell body 1000, and the limiting disk 3002 rotates synchronously with the dumbbell body 1000.

In this embodiment, the first stationary part 3006 and the second stationary part 3008 are circular, and the first rotating part 3005 and the second rotating part 3007 are hexagonal. In other embodiments, the first stationary part 3006 and the second stationary part 3008 are not limited to being circular, and the first rotating part 3005 and the second rotating part 3007 are not limited to being hexagonal, but can also be elliptical, triangular, quadrilateral, pentagonal, heptagonal and other arbitrary geometric shapes.

In this embodiment, the stationary through hole 3009 is circular and the rotating through hole 3010 is hexagonal. In other embodiments, the stationary through hole 3009 is not limited to being circular, and the rotating through hole 3010 is not limited to being hexagonal, but can also be set to be elliptical, triangular, quadrilateral, pentagonal, heptagonal and other arbitrary geometric shapes.

As shown in FIGS. 4 to 14, in this embodiment, the accommodating disk 3001 is provided with a first accommodating groove 3011, the limiting chamber 4001 is arranged in the first accommodating groove 3011; the accommodating disk 3001 is provided with a second accommodating groove 3012 and a third accommodating groove 3013, and the limiting disk 3002 is arranged in the third accommodating groove 3013 and the second accommodating groove 3012 of the adjacent weight plate set 2000. A fifth accommodating groove 3014 is also arranged on the accommodating disk 3001, and the weight plate 2001 is arranged in the fifth accommodating groove 3014.

Wherein, two ends of the handle part 1001 are provided with handle disks 1004, and the handle disk 1004 is provided with a sixth accommodating groove 3015. The limiting disk 3002 in the first-level weight plate set 2003 is arranged in the third accommodating groove 3013 and the sixth accommodating groove 3015 in the first-level weight plate set 2003. In other embodiments (not shown in the figure), the second accommodating groove or the third accommodating groove can be deepened, and the limiting disk can be arranged in the third accommodating groove or the second accommodating groove of an adjacent weight plate set. Wherein, the accommodating disk 3001 is provided with a clamping part 2008, and the weight plate 2001 is provided with a configuration part 2009.

As shown in FIGS. 7 to 12, in this embodiment, the limiting device 4000 includes a limiting chamber 4001, which includes a limiting shell 4007 and a limiting cover 4008, wherein the limiting cover 4008 corresponds to the limiting shell 4007; a first limiting block 4009 and a second limiting block 4010 are arranged in the limiting shell 4007, and a first limiting opening 4011 and a second limiting opening 4012 are arranged on the limiting shell 4007, wherein the first limiting opening 4011 corresponds to the first limiting block 4009 and the second limiting opening 4012 corresponds to the second limiting block 4010.

In this embodiment, there are two limiting blocks 4002. In other embodiments, the number of limiting blocks 4002 is not limited to two, but can also be set to one, three, four, five, six and any desired number.

As shown in FIGS. 3 to 12, in this embodiment, a first elastic part 4013 and a second elastic part 4016 are arranged in the limiting chamber 4001, wherein the first elastic part 4013 pushes against the first limiting block 4009 and the second elastic part 4016 pushes against the second limiting block 4010;

the limiting shell 4007 is provided with a first positioning post 4014 and a second positioning post 4017, wherein the first positioning post 4014 corresponds to the first elastic part 4013 and the second positioning post 4017 corresponds to the second elastic part 4016;

The first limiting block 4009 is provided with a first positioning groove 4015 corresponding to the first elastic part 4013, and the second limiting block 4010 is provided with a second positioning groove 4018 corresponding to the second elastic part 4016. The limiting shell 4007 is also provided with a first viewing port 4027 and a second viewing port 4028. The first viewing port 4027 corresponds to the first elastic part 4013 and the second viewing port 4028 corresponds to the first elastic part 4013, which is convenient for injection molding and can also be used for observing whether the first elastic part and the second elastic part work normally.

In this embodiment, the first elastic part 4013 and the second elastic part 4016 are provided as compression springs. In other embodiments (not shown in the figure), the first elastic part and the second elastic part are not limited to being set as compression springs, but can also be set as tension springs, torsion springs, bending springs, elastic washers, elastic pins, elastic sleeves and any elastic parts as desired.

As shown in FIGS. 7 to 12, in this embodiment, at least one limiting block 4002 and at least one transmission block 4003 are arranged in the limiting chamber 4001, wherein the limiting block 4002 corresponds to the locking notch 5000, and the transmission block 4003 pushes the limiting block 4002.

In this embodiment, the transmission block 4003 is provided with an abutting block 4004, and the limiting chamber 4001 is provided with at least one limiting opening 4005 and at least one abutting opening 4006, wherein the limiting opening 4005 corresponds to the limiting block 4002, and the abutting opening 4006 corresponds to the abutting block 4004, and the abutting block 4004 is movably arranged in the limiting rail groove 6001;

in this embodiment, the limiting shell 4007 is provided with a positioning strip 4019, and the transmission block 4003 is provided with a sliding groove 4020 corresponding to the positioning strip 4019, and the transmission block 4003 is slidably arranged in the limiting shell 4007.

In this embodiment, the transmission block 4003 is provided with a first thrust inclined plane 4021 and a second thrust inclined plane 4022, the first limiting block 4009 is provided with a first receiving inclined plane 4023 corresponding to the first thrust inclined plane 4021, and the second limiting block 4010 is provided with a second receiving inclined plane 4024 corresponding to the second thrust inclined plane 4022.

In this embodiment, the transmission block 4003 is provided with a first thrust inclined plane 4021 and a second thrust inclined plane 4022. In other embodiments (not shown in the figure), the transmission block is provided with a first thrust inclined plane and a second thrust inclined plane, and the number of thrust inclined plane can also be set to be one, three, four, five, six and any desired number. The inclined plane can be a flat surface with an angle or a curved surface with an angle.

Figure 6:
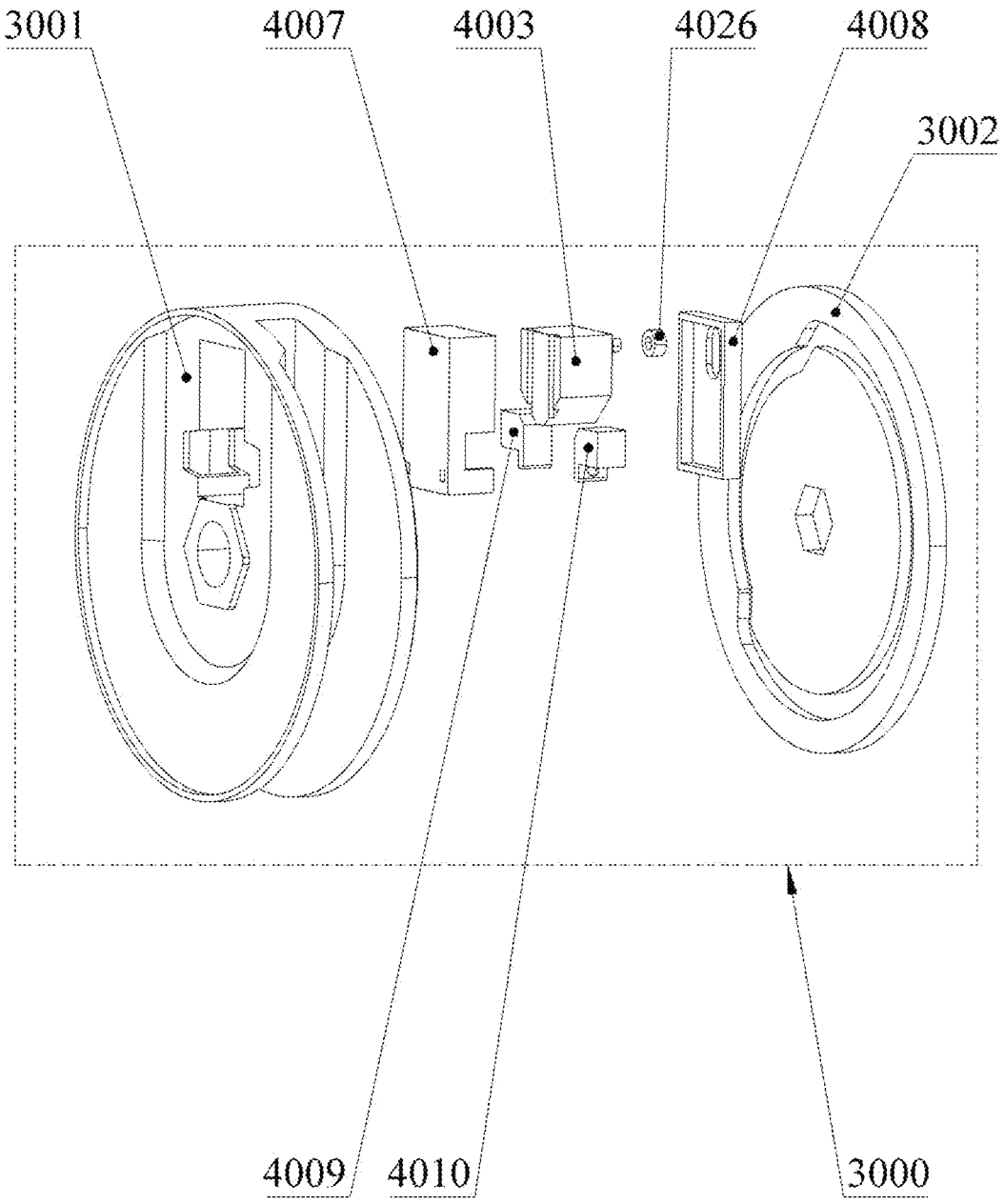
FIG. 6 is an exploded view of the locking mechanism.
Figure 7:
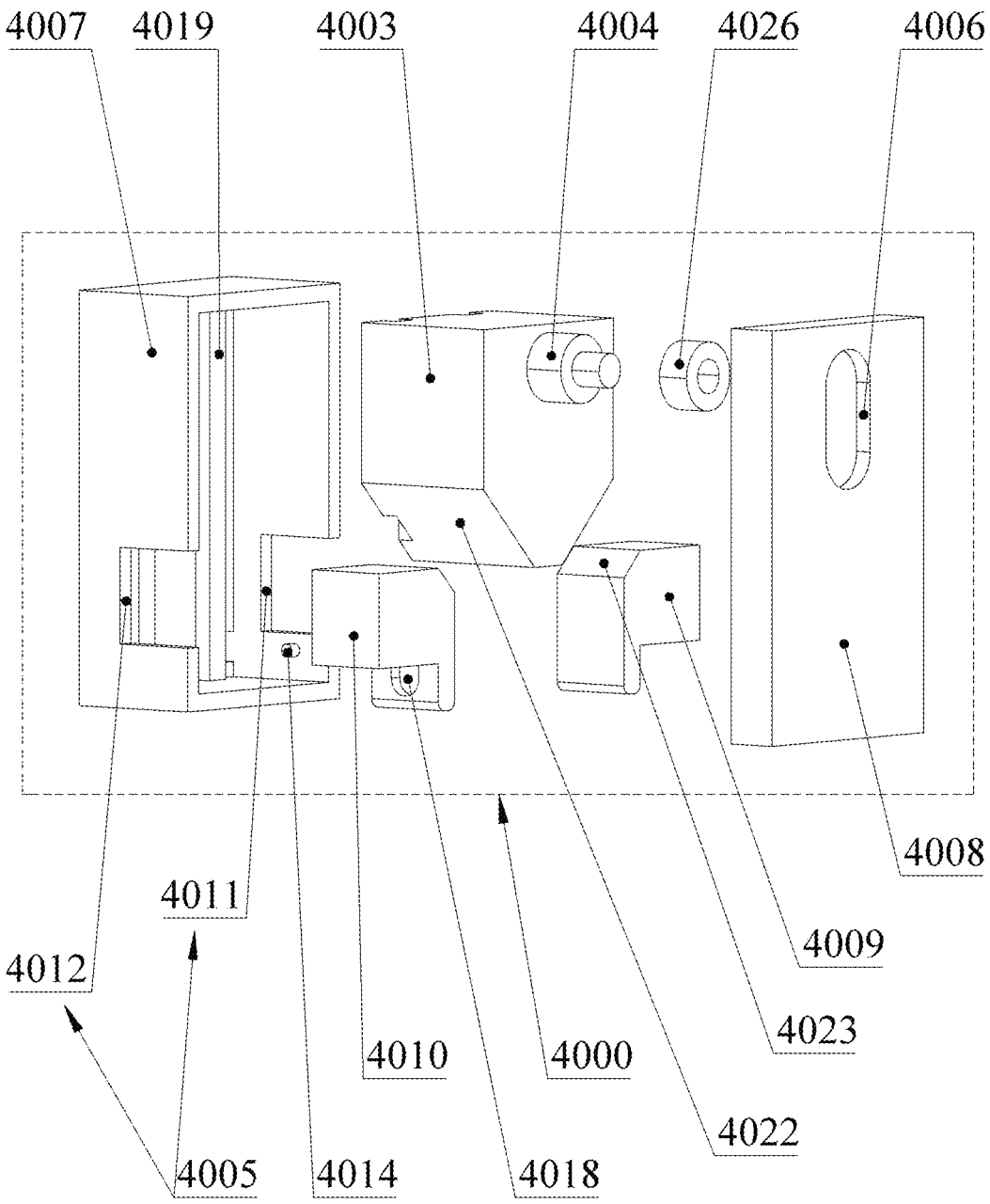
FIG. 7 is an exploded view of the limiting device.
Figure 8:
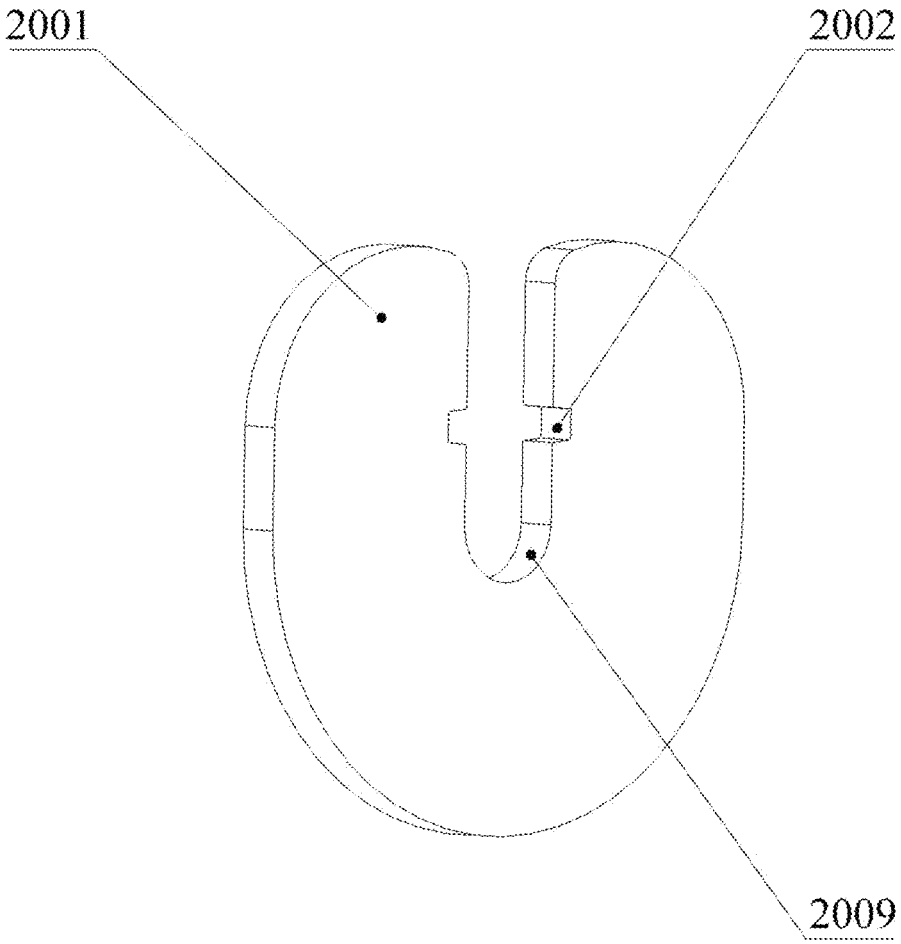
FIG. 8 is a schematic diagram of a weight plate.
Figure 9:
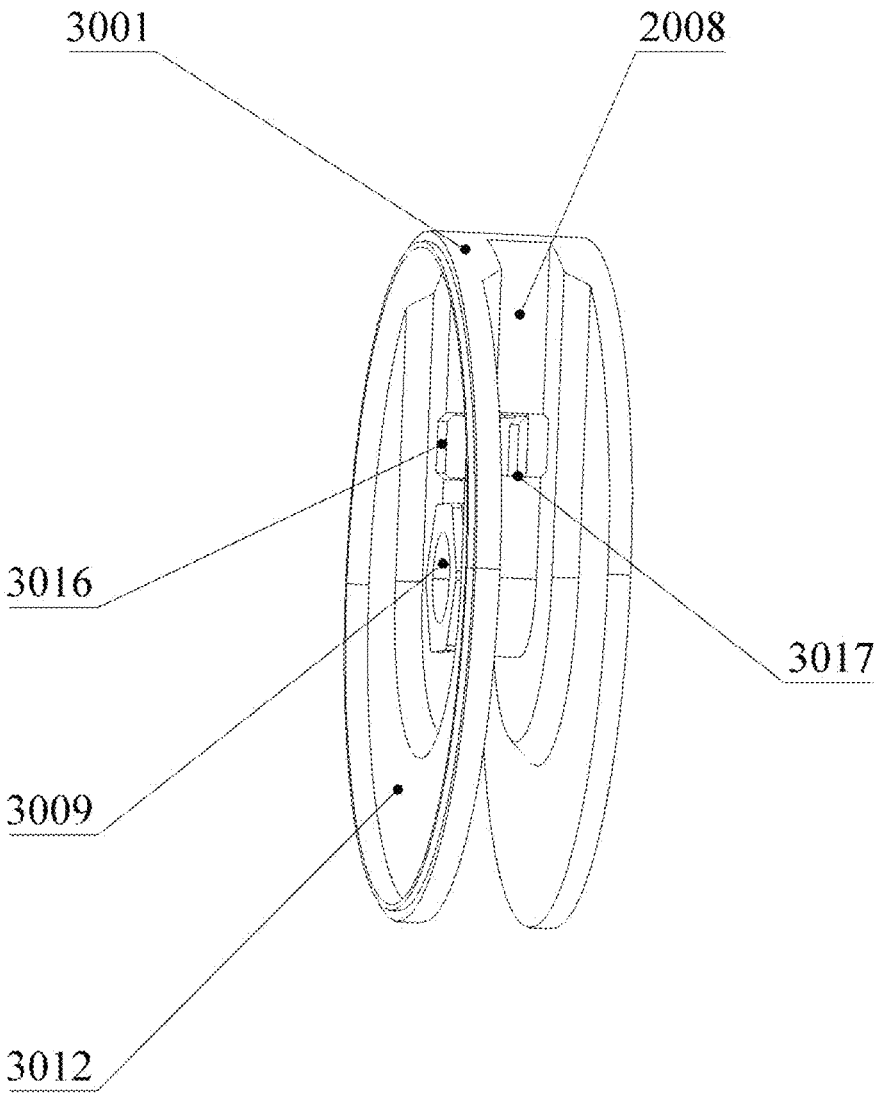
FIG. 9 is a schematic view of an accommodating disk.
Figure 10:
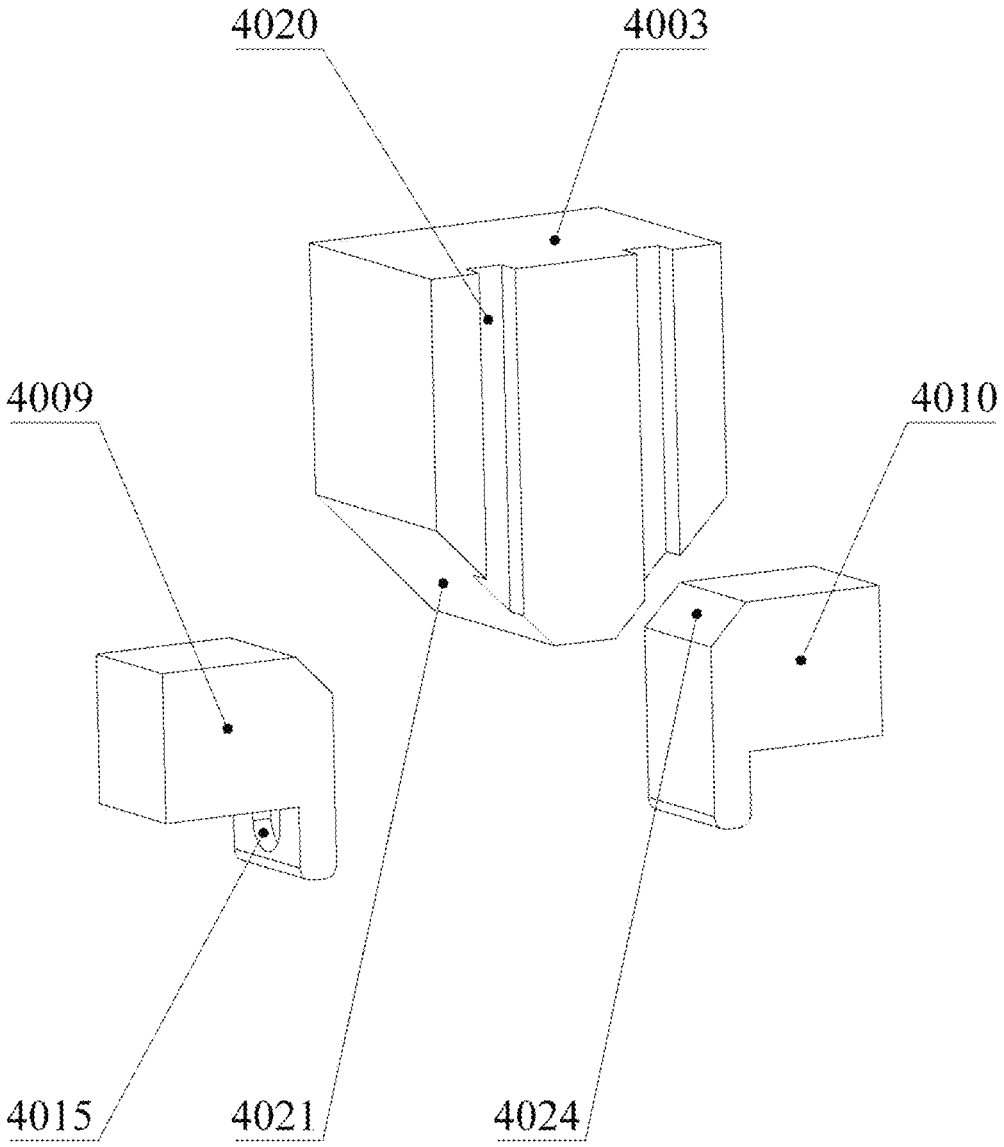
FIG. 10 is a partial schematic view of FIG. 7.
Figure 11:
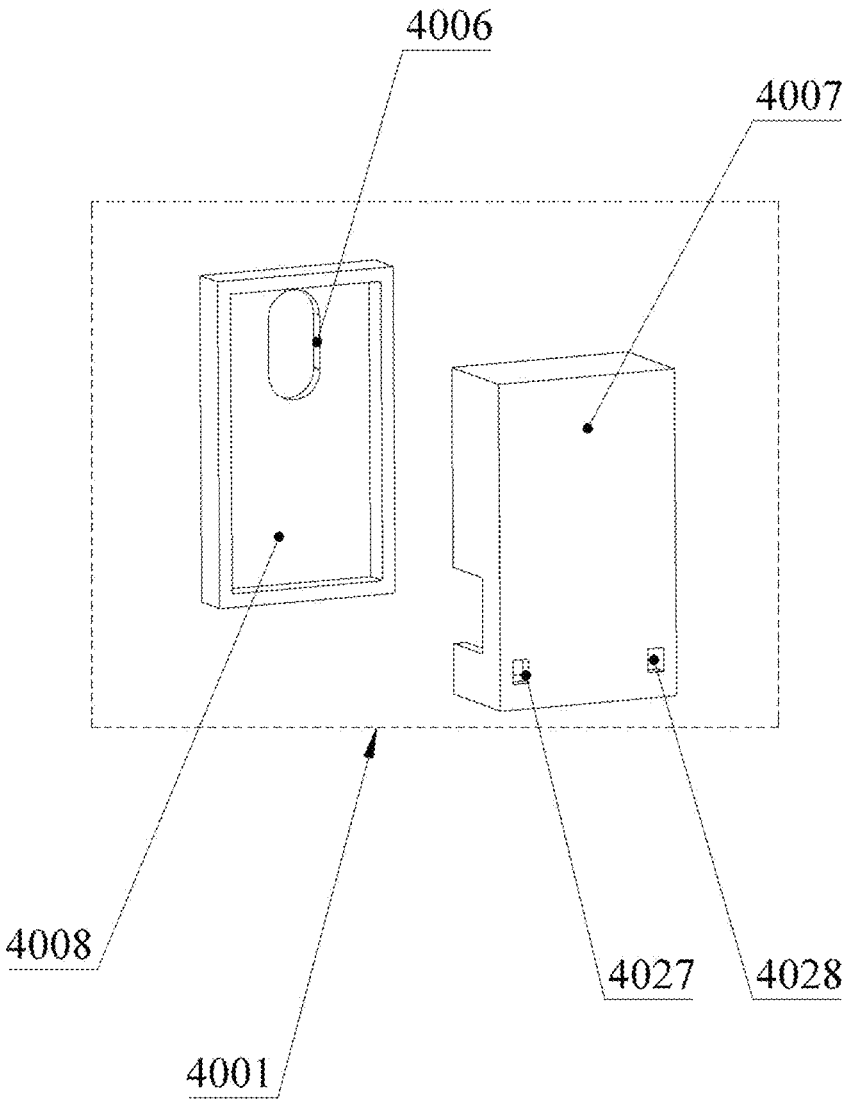
FIG. 11 is a schematic view of the limiting chamber.
Figure 12:
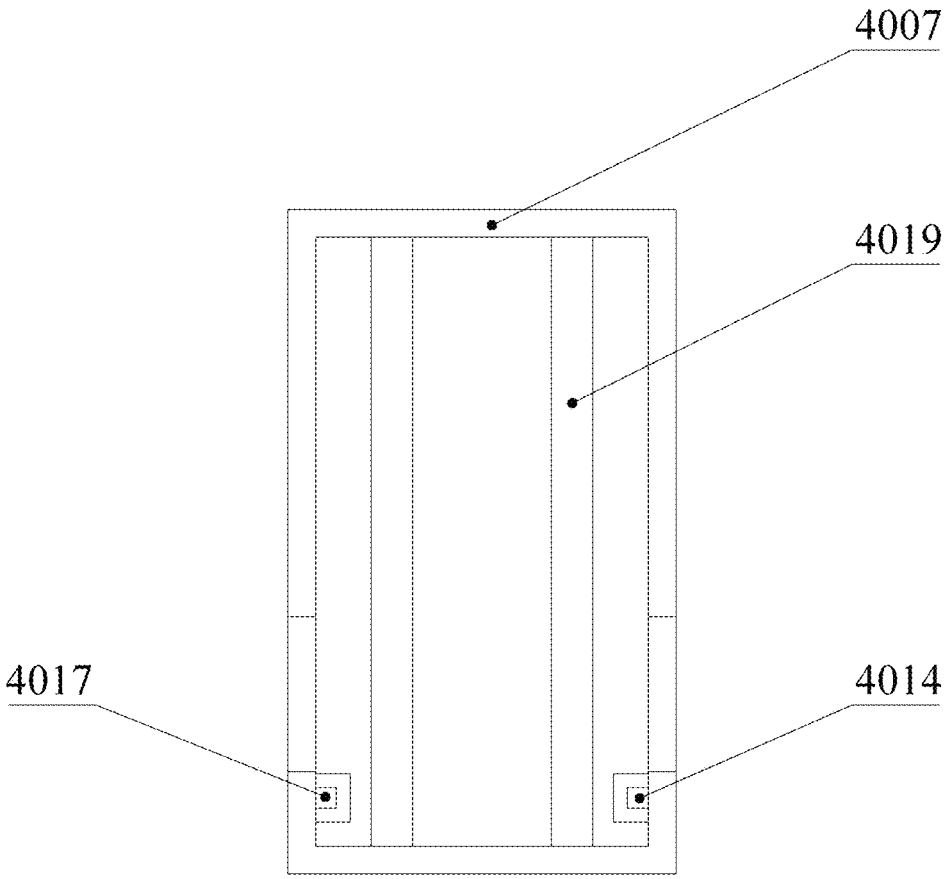
FIG. 12 is a schematic view of the limiting shell.
Figure 13:
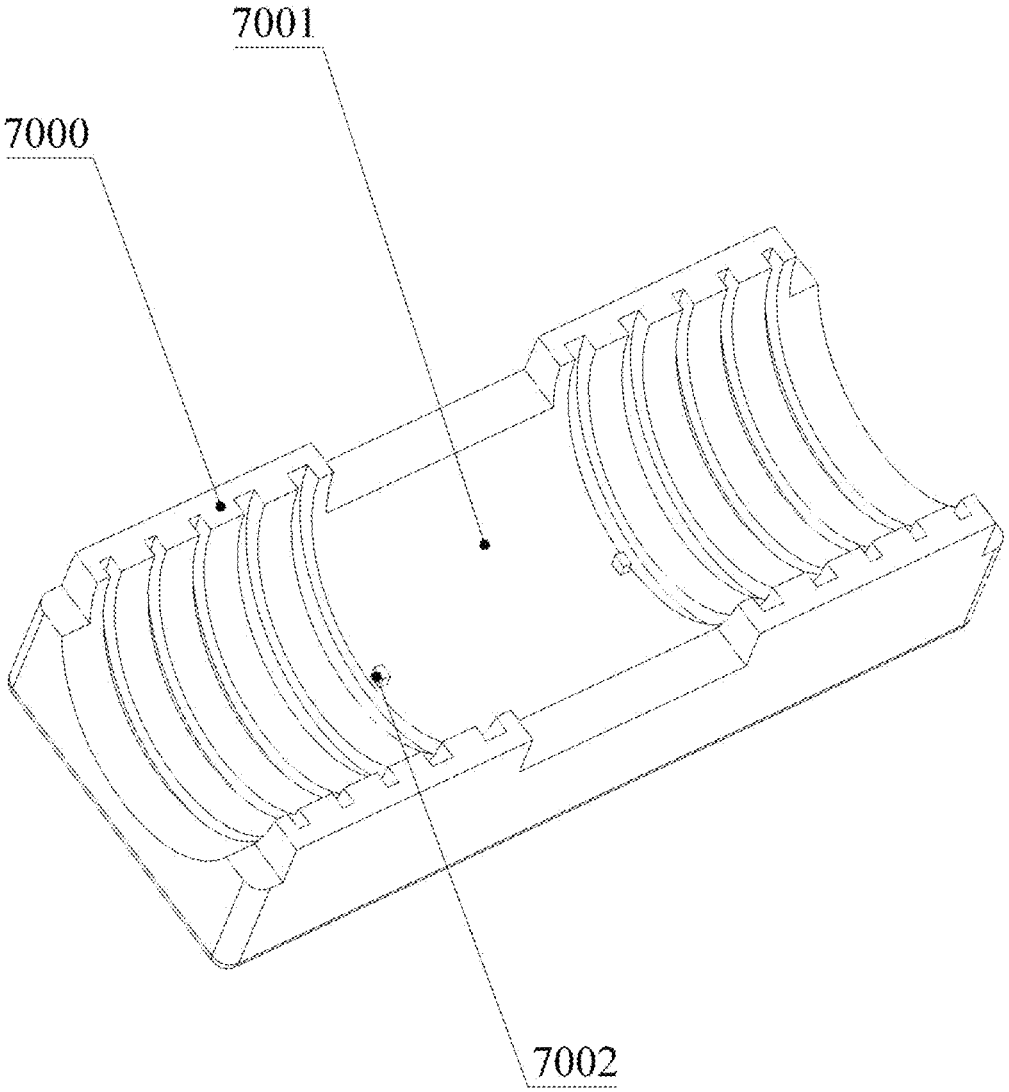
FIG. 13 is a schematic view of the base.
Figure 14:
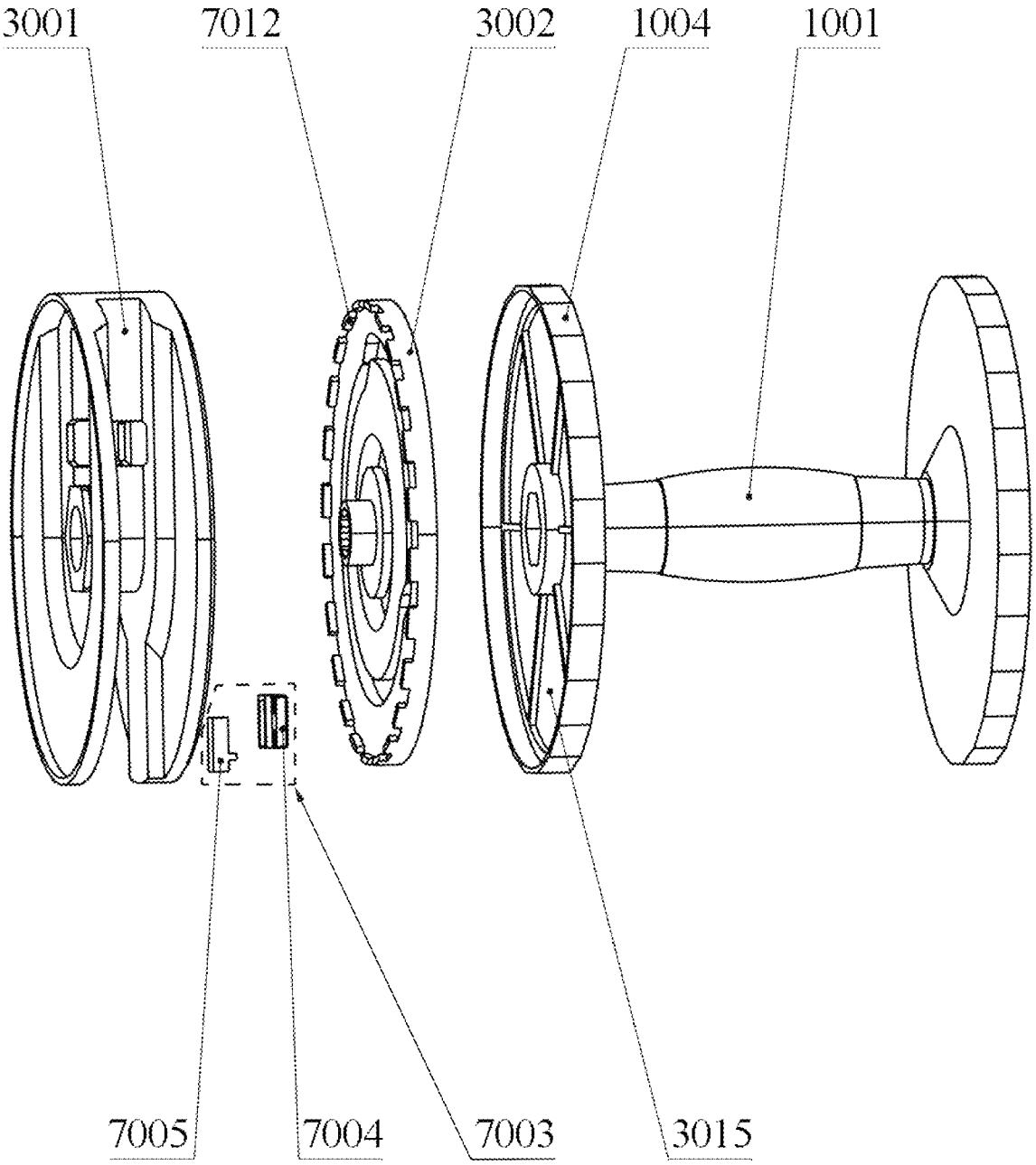
FIG. 14 is a schematic view of the locking mechanism.

As shown in FIGS. 6 to 7, in this embodiment, the limiting cover 4008 is provided with an abutting opening 4006, which corresponds to the abutting block 4004; the abutting block 4004 abuts against the limiting disk 3002 through the abutting opening 4006, and the abutting block 4004 is arranged in the limiting rail groove 6001, wherein the abutting block 4004 is provided with an abutting roller 4026, and the abutting block 4004 is movably connected with the limiting rail groove 6001 through the abutting roller 4026.

In this embodiment, the abutting block 4004 is movably connected with the limiting rail groove 6001 through the abutting roller 4026. In other embodiments (not shown in the figure), the abutting block is not limited to the movable connection with the limiting rail groove through the abutting roller, but can also be arranged as balls, bearings and other arbitrary structures as desired.

As shown in FIGS. 1 to 9, in this embodiment, the accommodating disk 3001 is provided with a first locking notch 3016 and a second locking notch 3017, wherein the first locking notch 3016 corresponds to the first limiting opening 4011 and the second locking notch 3017 corresponds to the second limiting opening 4012.

When the abutting block 4004 is located in the locking section 6002, the transmission block 4003 pushes the first limiting block 4009 and the second limiting block 4010 out of the first limiting opening 4011 and the second limiting opening 4012 to be received and locked by the first locking notch 3016 and the second locking notch 3017.

When the abutting block 4004 is located in the opening block 6003, the first elastic part 4013 and the second elastic part 4016 push the first limiting block 4009 and the second limiting block 4010 away from the first locking notch 3016 and the second locking notch 3017.

In this embodiment, two locking notches 5000 are provided on the accommodating disk 3001. In other embodiments (not shown in the figure), the accommodating disk is not limited to being provided with two locking notches, and the number may also be set to one, three, four, five, six, seven and any number as desired.

As shown in FIGS. 13 to 16, this embodiment further includes a base 7000, on which a base groove 7001 is provided; the base groove can accommodate the dumbbell body 1000 and the weight plate set 2000; at least one unlocking block 7002 is provided on the base groove 7001, and a second locking mechanism 7003 is provided-on the first-level weight plate set 2003, wherein the unlocking block 7002 corresponds to the second locking mechanism 7003. The second locking mechanism 7003 includes a locking shell 7004 and a second locking block 7005.

In this embodiment, two unlocking blocks 7002 are provided on the base groove 7001. In other embodiments (not shown in the figure), the base groove is not limited to being provided with two unlocking blocks, but the number may be one, three, four, five, six, seven and any desired number.

Specifically, a locking shell 7004 is provided on the accommodating disk 3001 of the first-level weight plate set 2003, and a second locking block 7005 is provided on the locking shell 700; a third elastic part 7006 is provided on the lock shell 7004, and the third elastic part 7006 pushes against the second locking block 7005; a third positioning post 7007 is provided on the lock shell 7004, and the third positioning post 7007 corresponds to a third elastic part 7006; the second locking block 7005 is provided With a third positioning groove 7008, and the third positioning groove 7008 corresponds to the third elastic part 7006.

Among them, the accommodating disk 3001 is provided with a locking groove 7009 and a locking opening 7010, and the locking groove 7009 and the locking opening 7010 correspond to the second locking block 7005; the second locking block 7005 is arranged in the locking groove 7009 and the locking shell 7004. The second locking block 7005 is provided with a locking projection 7011, and the limiting disk 3002 of the first-level weight plate set 2003 is provided with a locking tooth 7012. The locking tooth 7012 corresponds to the locking projection 7011, and the second locking block 7005 has a first position and a second position.

In this embodiment, the third elastic part 7006 is provided as a compression spring. In other embodiments (not shown in the figure), the third elastic part is not limited to being set as a compression spring, but can also be set as a tension spring, a torsion spring, a bending spring, an elastic washer, an elastic pin, an elastic sleeve and any other elastic part as desired.

When the third elastic part 7006 pushes against the second locking block 7005, the second locking block 7005 is disposed in the locking opening 7010, and the locking projection 7011 is engaged with the locking tooth 7012, that is, it is in the first position, in which the accommodating disk 3001 and the limiting disk 3002 of the first-level weight plate set 2003 cannot rotate relative to each other.

When the dumbbell is put into the base 7000, the unlocking block 7002 pushes against the second locking block 7005 through the unlocking opening, and the locking projection 7011 is far away from the locking tooth 7012, that is, in the second position, in which the accommodating disk 3001 and the limiting disk 3002 of the first-level weight plate set 2003 can rotate relative to each other.

After picking up the dumbbell from the base 7000, the second locking block 7005 is pushed back by the third elastic part 7006 to be in the first position again, so that the accommodating disk 3001 and the limiting disk 3002 of the first-level weight plate set 2003 cannot rotate relative to each other.

In other embodiments (not shown in the figure), the locking mechanism is not limited to form the locking formed by the engagement of the locking protrusions with the locking tooth, but can also form locking by buckles, screws, pins, magnetic attraction parts and any other ways as desired.

Figure 15:
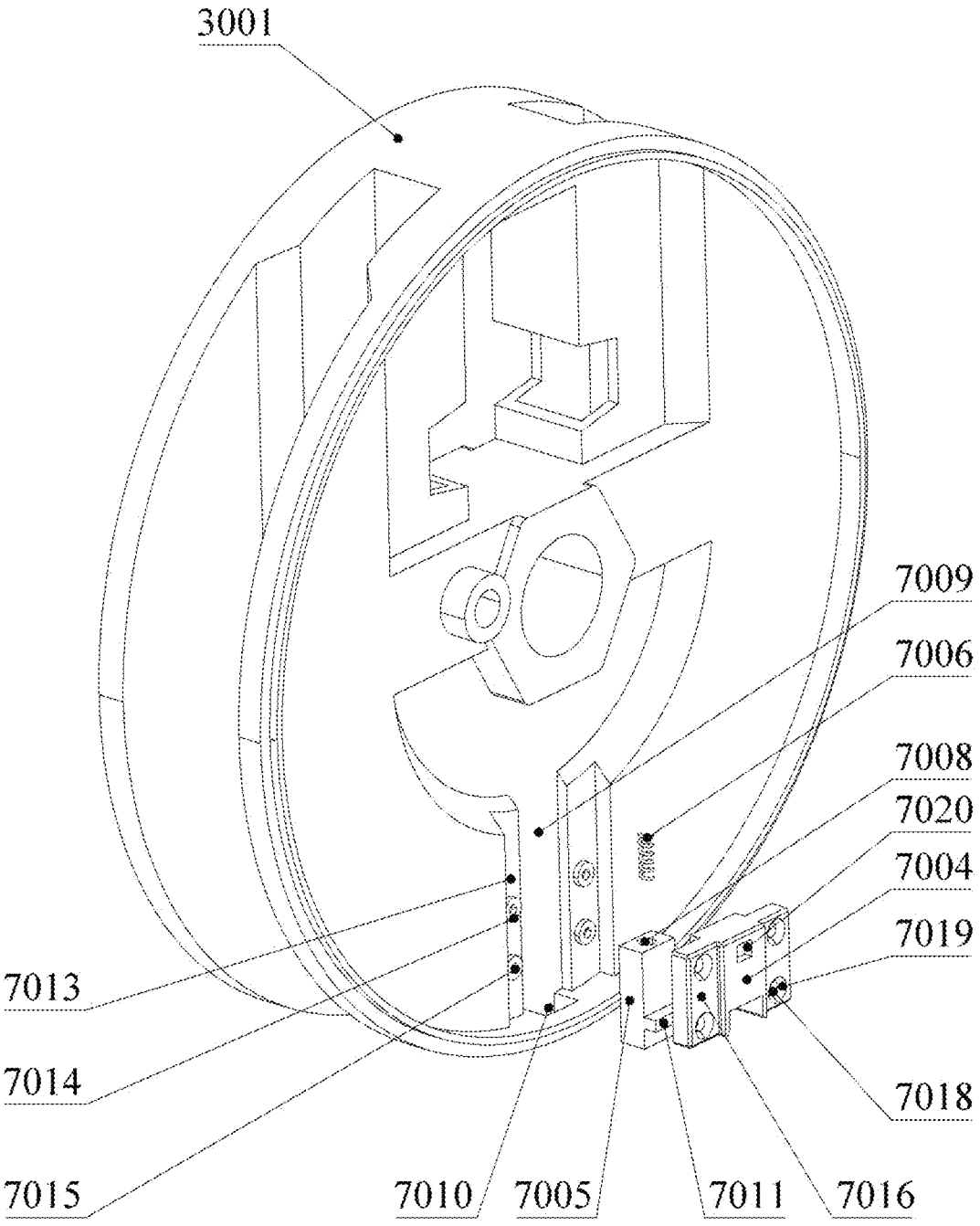
FIG. 15 is a partial schematic view of FIG. 14.
Figure 16:
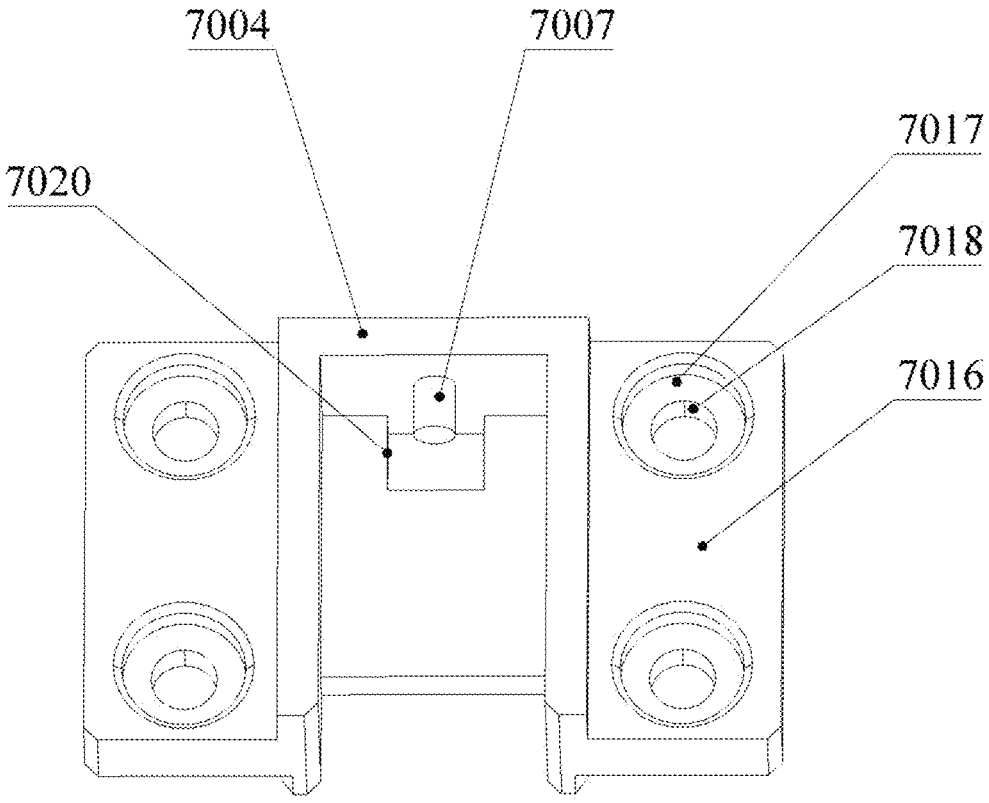
FIG. 16 is a schematic view of the locking shell.
Figure 17:
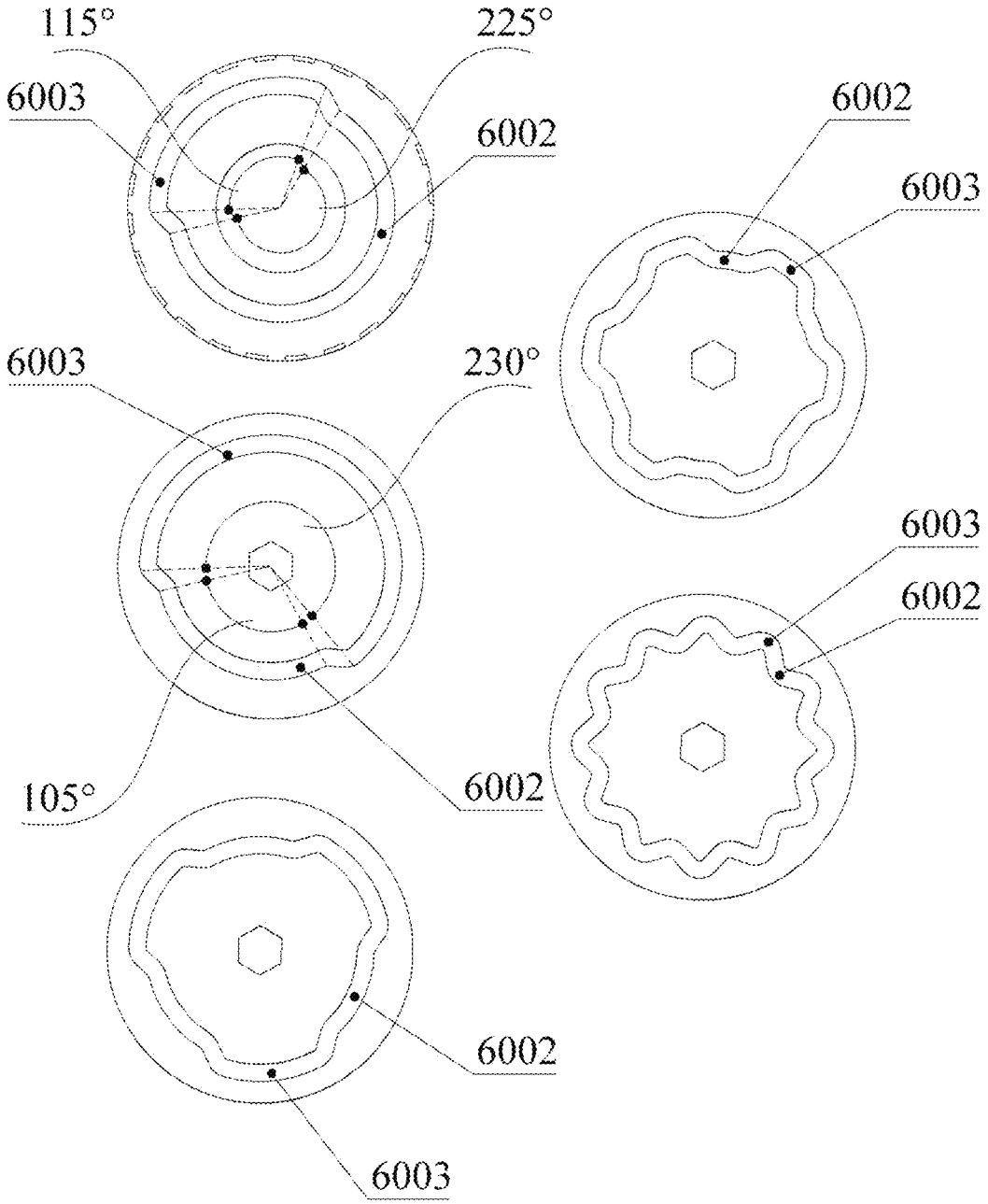
FIG. 17 is a schematic diagram of the limiting disk in each weight plate set.
Figure 19:
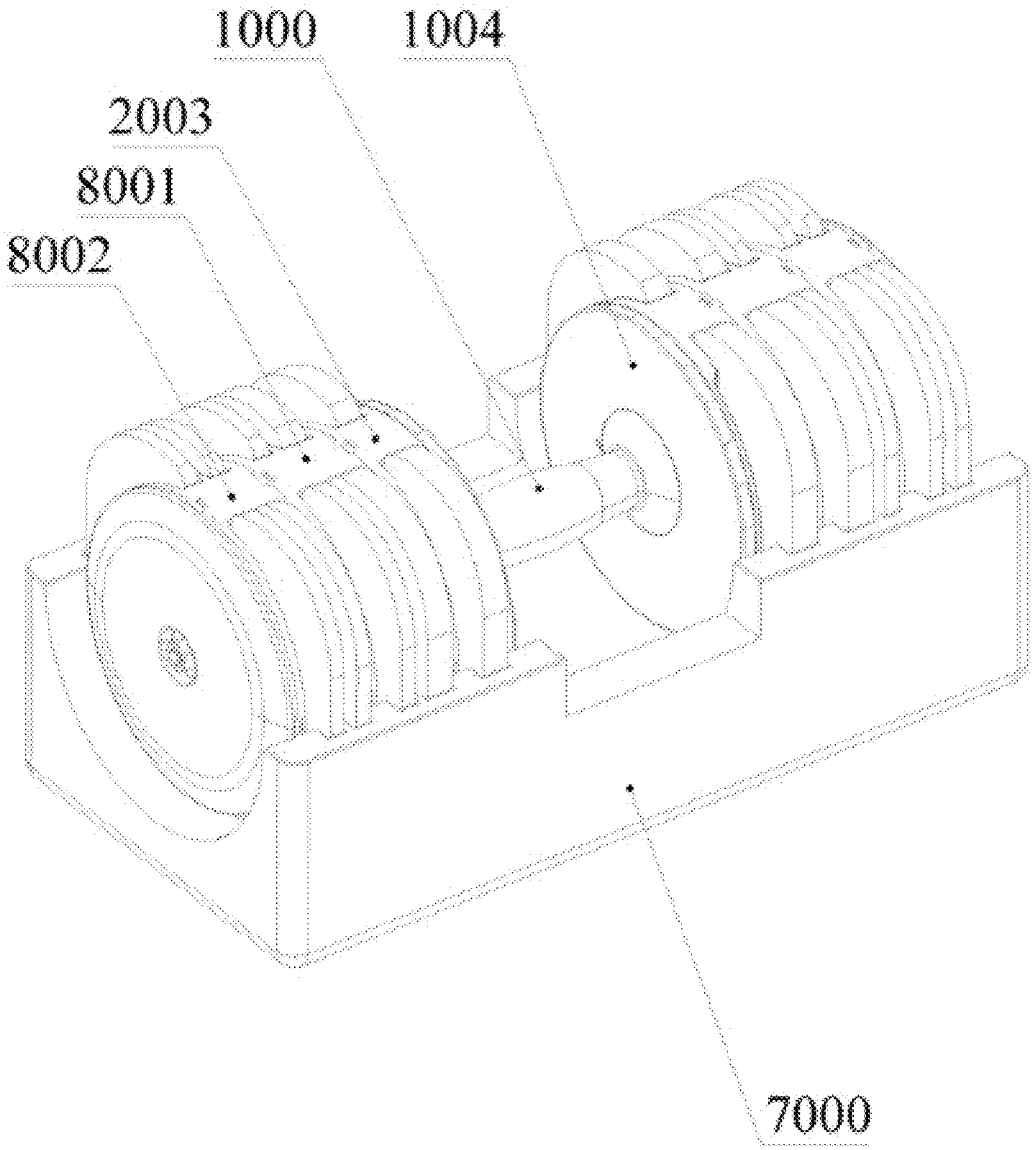
FIG. 19 is a schematic view of another embodiment of a dumbbell.
Figure 20:
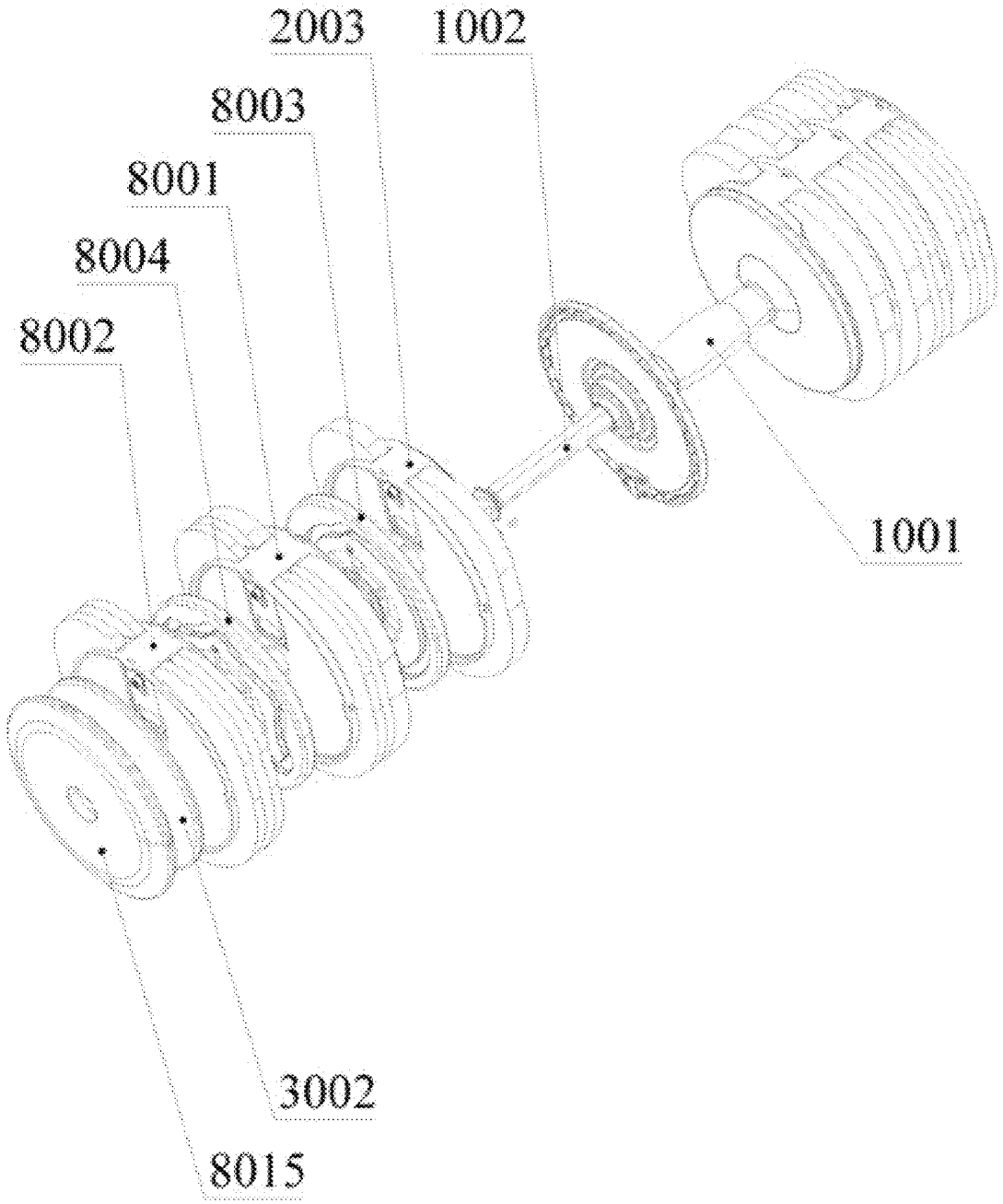
FIG. 20 is a partial explosion diagram of FIG. 19.
Figure 21:
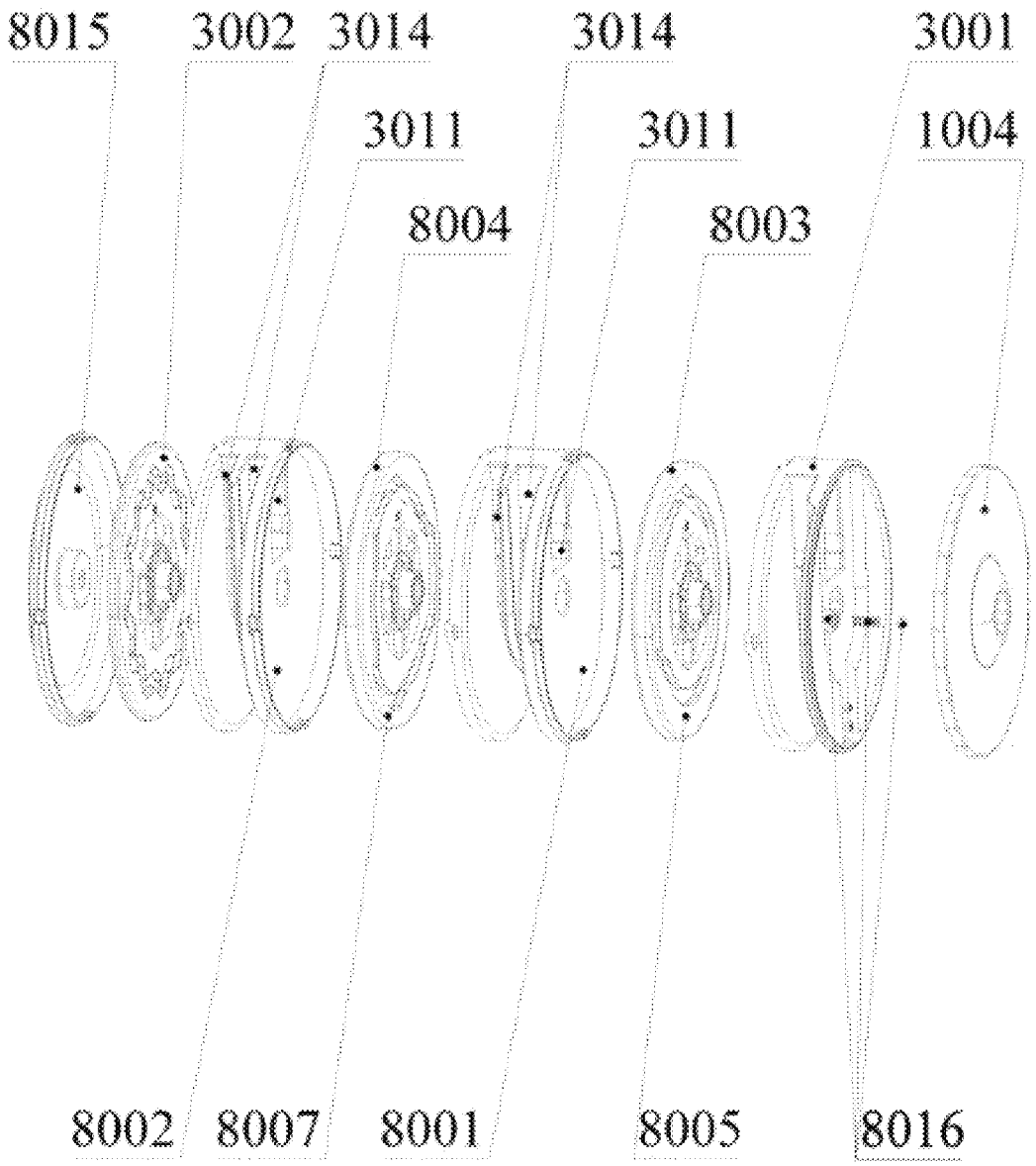
FIG. 21 is a partial explosion diagram of FIG. 20.
Figure 22:
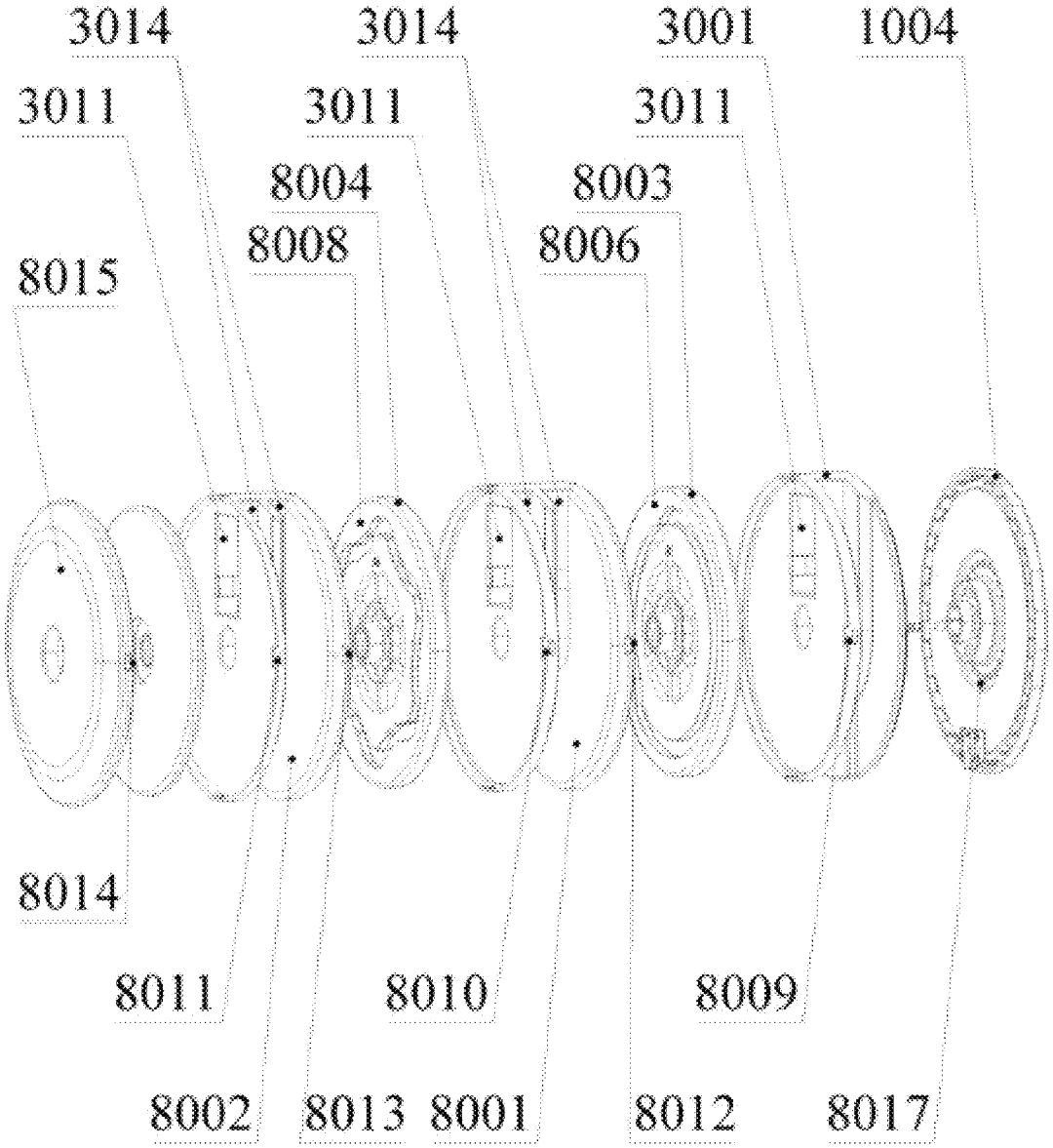
FIG. 22 is another schematic view of FIG. 21.

As shown in FIG. 15 and FIG. 16, in this embodiment, at least one first connecting edge 7013 is provided on the accommodating disk 3001, at least one first boss 7014 is provided on the first connecting edge 7013, and a first fixing hole 7015 is provided on the first boss 7014;

at least one second connecting edge 7016 corresponding to the first connecting edge 7013 is arranged on the locking shell 7004, and at least one first groove 7017 corresponding to the first boss 7014 is arranged on the second connecting edge 7016, and a second fixing hole 7018 corresponding to the first fixing hole 7015 is arranged on the first groove 7017, wherein the accommodating disk 3001 and the locking shell 7004 are fixedly connected by fasteners. The third viewing port 7020 is convenient for injection molding, and can also be used to observe whether the third elastic part 7006 works normally.

In this embodiment, the accommodating disk 3001 and the locking shell 7004 are fixedly connected by fixing parts, which can be set as screws, pins, rivets, bolts and any desired fixing parts. In other embodiments (not shown in the figure), the accommodating disk and the locking shell are not limited to being fixedly connected by fixing parts, but also can be connected by snap connection, welding, hook and loop and any other desired connection methods.

As shown in FIGS. 19 to 24, another embodiment provided by the present invention is different from the above-mentioned embodiment in that, in this embodiment, the number of weight plate sets 2000 is reduced while the number of weight plates 2001 is the same, specifically, the numbers of accommodating disks 3001 and limiting disks 3002 are reduced.

In this embodiment, the accommodating disk 3001 includes a first combined accommodating disk 8001 and a second combined accommodating disk 8002; wherein, the accommodating disk 3001 combining the second-stage weight plate set 2004 and the third-stage weight plate set 2005 is the first combined accommodating disk 8001, and the accommodating disk 3001 combining the fourth-level stage weight plate set 2006 and the fifth-level weight plate set 2007 is the second combined accommodating disk 8002. The limiting disk 3002 combining the first-stage weight plate set 2003 and the first-stage weight plate set 2005 is the first combined limiting disk 8003, and the limiting disk 3002 combining the fourth-level weight plate set 2006 and the fourth-level weight plate set 2007 is the second combined limiting disk 8004.

As shown in FIGS. 19 to 22, in this embodiment, the clamping part 2008 and the configuration part 2009 are respectively provided with two fifth accommodating grooves 3014 for accommodating the weight plate 2001 and two first accommodating grooves 3011 for accommodating the limiting device 4000. The directions of the limiting devices 4000 in the same combined set are set such that the transmission blocks 4003 are arranged relatively outward.

In this embodiment, the first combined limiting disk 8003 is arranged between the accommodating disk 3001 of the first-level weight plate set 2003 and the first combined accommodating disk 8001. The first combined limiting disk 8003 includes a first end face 8005 and a second end face 8006, the first end face 8005 is close to the accommodating disk 3001 of the first-level weight plate set 2003, and the second end face 8006 is close to the first combined accommodating disk 8001; the first end face 8005 is provided with a limiting rail groove 6001 of the first-level weight plate set 2003; the second end face 8006 is provided with a limiting rail groove 6001 of the second-stage weight plate set 2004.

In this embodiment, the second combined limiting disk 8004 is arranged between the first combined accommodating disk 8001 and the second combined accommodating disk 8002. The second combined limiting disk 8004 includes a third end face 8007 and a fourth end face 8008, the third end face 8007 is close to the first combined accommodating disk 8001 and the fourth end face 8008 is close to the second combined accommodating disk 8002; the third end face 8007 is provided with the limiting rail groove 6001 of the third-stage weight plate set 2005; the fourth end face 8008 is provided with a limiting rail groove 6001 of the fourth-level weight plate set 2006. The limiting disk 3002 and the cover plate 8015 of the fifth-level weight plate set 2007 are arranged at the end of the second combined containing plate disk 8002 far away from the second combined limiting disk 8004.

As shown in FIGS. 19 to 22, in this embodiment, at least one first fixing part 8009 is arranged on the accommodating disk 3001 of the first-level weight plate set 2003, and a first fixing buckle 8012 corresponding to the first fixing part 8009 is arranged on the first combined accommodating disk 8001; at least one second retention part 8010 is arranged on the first combined accommodating disk 8001, and a second fixing buckle 8013 corresponding to the second retention part 8010 is arranged on the second combined accommodating disk 8002; at least one third retaining part 8011 is arranged on the second combined accommodating disk 8002, and a third fixing buckle 8014 corresponding to the third retaining part 8011 is arranged on the cover plate 8015.

Figure 23:
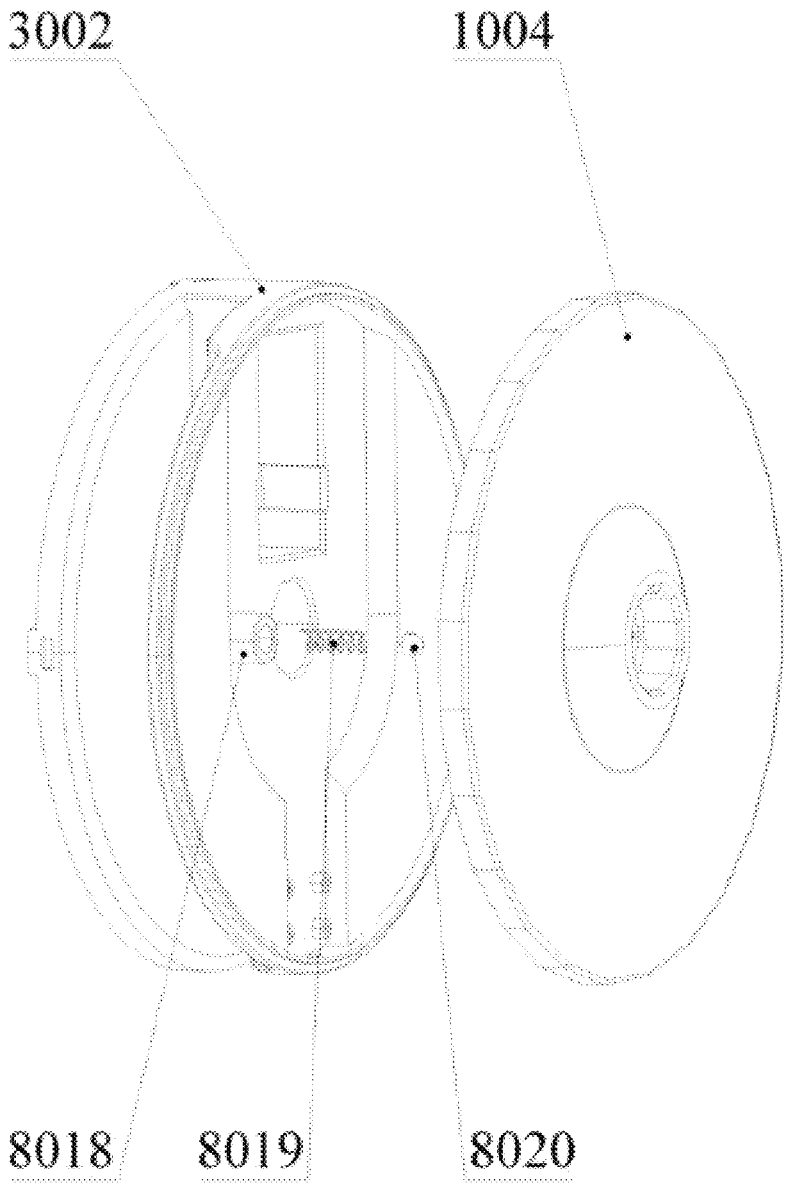
FIG. 23 is an exploded view of the gear part.
Figure 24:
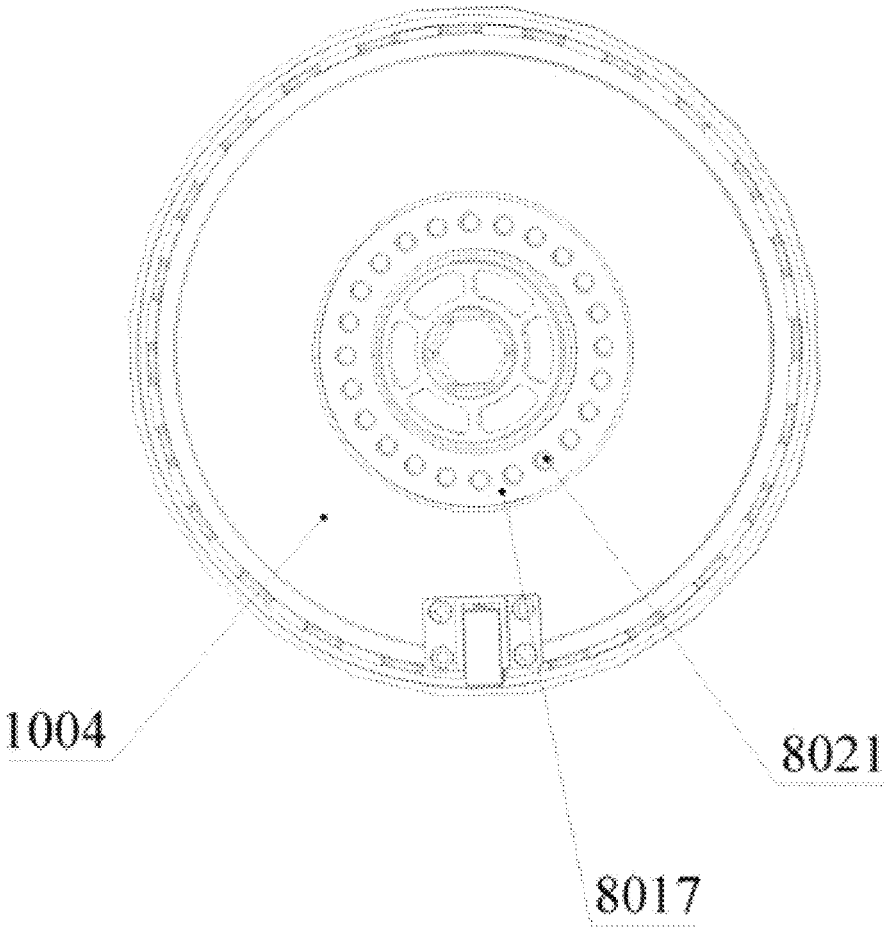
FIG. 24 is a schematic view of a gear ring part and a gear g groove.

The accommodating disk 3001 of the first-level weight plate set 2003 and the first combined accommodating disk 8001 are fixedly connected through the first fixing part 8009 and the first fixing buckle 8012; the first combined accommodating disk 8001 and the second combined accommodating disk 8002 are fixedly connected by the second retaining part 8010 and the second fixing buckle 8013; the second combined accommodating disk 8002 and the cover plate 8015 are fixedly connected by the third retaining part 8011 and the third fixing buckle 8014. As shown in FIGS. 23 to 24, in this embodiment, the accommodating disk 3001 of the first-level weight plate set 2003 is provided with a gear part 8016, and the sixth accommodating groove 3015 of the handle disk 1004 is provided with a gear ring part 8017 corresponding to the gear part 8016.

In this embodiment, the gear part 8016 includes a gear accommodating groove 8018, a fourth elastic member 8019 and a gear fixture block 8020. Gear grooves 8021 are distributed around the driving rod 1002 on the gear part 8016. The fourth elastic member 8019 and the gear fixture block 8020 are arranged in the gear accommodating groove 8018, and the fourth elastic member 8019 elastically pushes the gear fixture block 8020 to be matched with the gear groove 8021. The user is allowed have a sense of gear when rotating the driving rod 1002, and know his own rotation angle more clearly, so as to select the plate accurately.

The present invention also provides an exercise method using dumbbells, which includes the following steps: providing a dumbbell, wherein the dumbbell includes a dumbbell body, wherein a plurality of weight plate sets are arranged on the dumbbell body;

the weight plate set includes weight plates and a locking mechanism;

wherein, the locking mechanism includes an accommodating disk, and a limiting device and a limiting disk are arranged on the accommodating disk;

the limiting device includes at least one limiting block and at least one transmission block, wherein the limiting block has a locking position and a releasing position driven by the transmission block;

a limiting rail groove is arranged on the limiting disk, the limiting rail groove is provided with a locking section and an opening section, and the transmission block is slidably arranged in the limiting rail groove, wherein at least one locking notch is also arranged on the accommodating disk, and the locking notch corresponds to the limiting block;

when the transmission block is located in the locking section, the limiting block is arranged in the locking notch, and when the transmission block is located in the opening section, the limiting block is far away from the locking notch;

wherein, at least one locking part is arranged on the weight plate, and the locking part corresponds to the locking notch;

when the limiting block is in the locking position, the limiting block is arranged in the locking part through the locking notch, and when the limiting block is in the releasing position, the limiting block is far away from the locking part;

rotating the dumbbell body to make the locking mechanism lock the weight plate; and using the dumbbell for trainings such as pushing, lifting, lifting and squatting.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed is:

1. A locking mechanism for weight plates, comprising:

an accommodating disk, wherein a limiting device and a limiting disk are arranged on said accommodating disk; and said limiting device comprises at least one limiting block and at least one transmission block, wherein said at least one limiting block has a locking position and a releasing position driven by said at least one transmission block; and a limiting rail groove is arranged on said limiting disk, and said limiting rail groove is provided with a locking block and an opening block; and said at least one transmission block is slidably arranged in said limiting rail groove, at least one locking notch is also arranged on said accommodating disk, and said at least one said locking notch corresponds to said at least one limiting block; and when said at least one transmission block is located in said locking block, said at least one limiting block is arranged in said at least one said locking notch, and when said at least one transmission block is located in said opening block, said at least one limiting block is away from said at least one said locking notch.

2. The locking mechanism for weight plates according to claim 1, wherein said limiting device comprises a limiting chamber, and said limiting chamber comprises a limiting shell and a limiting cover, wherein said limiting cover corresponds to said limiting shell; and the at least one limiting block comprises a first limiting block and a second limiting block arranged in said limiting shell, wherein a first limiting opening and a second limiting opening are arranged on said limiting shell, wherein said first limiting opening corresponds to said first limiting block and said second limiting opening corresponds to said second limiting block.

3. The locking mechanism for weight plates according to claim 2, wherein a first elastic part and a second elastic part are arranged in said limiting chamber, wherein said first elastic part pushes against said first limiting block and said second elastic part pushes against said second limiting block.

4. The locking mechanism for weight plates according to claim 3, wherein said at least one limiting block and said at least one transmission block are arranged in said limiting chamber, wherein said at least one limiting block corresponds to said at least one said locking notch and said at least one transmission block pushes against said at least one limiting block; and said at least one transmission block is provided with an abutting block, and said limiting chamber is provided with at least one of the first limiting opening and the second limiting opening and at least one abutting opening, wherein said at least one of the first limiting opening and the second limiting opening corresponds to said at least one limiting block, said at least one abutting opening corresponds to said abutting block, and said abutting block is movably arranged in said limiting rail groove.

5. The locking mechanism for weight plates according to claim 4, wherein said at least one abutting opening is arranged on said limiting cover, and said at least one abutting opening corresponds to said abutting block, and said abutting block abuts against said limiting disk through said at least one abutting opening, and said abutting block is arranged in said limiting rail groove, wherein said at least one said locking notch comprises a first locking notch and a second locking notch arranged on said accommodating disk, wherein said first locking notch corresponds to said first limiting opening and said second locking notch corresponds to said second limiting opening; and when said abutting block is located in said locking block, said at least one transmission block pushes said first limiting block and said second limiting block out of said first limiting opening and said second limiting opening to be received and locked by said first locking notch and said second locking notch; and when said abutting block is located in said opening block, said first elastic part and said second elastic part push against said first limiting block and said second limiting block, so that said first limiting block and said second limiting block are away from said first locking notch and said second locking notch.

6. A dumbbell comprising:

a dumbbell body, wherein a plurality of weight plate sets are arranged on said dumbbell body;

wherein each weight plate set of the plurality of weight plate sets comprises a weight plate and a locking mechanism; and each weight plate set of the plurality of weight plate sets is configured such that:

said locking mechanism comprises an accommodating disk, and a limiting device and a limiting disk are arranged on said accommodating disk;

said limiting device comprises at least one limiting block and at least one transmission block, wherein said at least one limiting block has a locking position and a releasing position driven by said at least one transmission block; and a limiting rail groove is arranged on said limiting disk, and said limiting rail groove is provided with at least one locking block and at least one opening block; said at least one transmission block is slidably arranged in said limiting rail groove, at least one locking notch is also arranged on said accommodating disk, and said at least one said locking notch corresponds to said at least one limiting block; and when said at least one transmission block is located in said at least one locking block, said at least one limiting block is arranged in said at least one said locking notch, and when said at least one transmission block is located in said at least one opening block, said at least one limiting block is away from said at least one said locking notch; and wherein, each weight plate set of the plurality of weight plate sets comprises at least one locking part arranged on the respective weight plate of the weight plate set, and said at least one locking part corresponds to said at least one said locking notch; and when said at least one limiting block is in said locking position, said at least one limiting block is arranged in said at least one locking part through said at least one said locking notch, and when said at least one limiting block is in said releasing position, said at least one limiting block is away from said locking part.

7. The dumbbell according to claim 6, wherein said dumbbell body comprises a handle part, and said plurality of weight plate sets are symmetrically arranged at both ends of said handle part, wherein said plurality of weight plate sets are arranged as a first-level weight plate set, a second-level weight plate set, a third-level weight plate set, a fourth-level weight plate set and a fifth-level weight plate set from a proximal position to a distal position relative to said handle part; and wherein, the at least one locking block of the respective rail groove of each weight plate set of the plurality of weight plate sets is a number of locking blocks, and the at least one opening block of the respective rail groove of each weight plate set of the plurality of weight plate sets is a number of opening blocks, wherein the number of locking blocks is different in the respective limiting rail grooves of each weight plate set of the plurality of weight plate sets, wherein the number of opening blocks is different in the respective limiting rail grooves of each weight plate set of the plurality of weight plate sets, and wherein a proportion of the number of opening blocks to the number of locking blocks is different in the respective limiting rail grooves of each weight plate set of the plurality of weight plate sets.

8. The dumbbell according to claim 7, wherein said dumbbell body comprises a driving rod, and said driving rod penetrates through said handle part and rotates synchronously with said handle part; and said locking mechanism of each weight plate set of the plurality of weight plate sets comprises a first sleeve ring and a second sleeve ring sleeved on said driving rod, wherein said first sleeve ring and said second sleeve ring rotate synchronously with said driving rod; said first sleeve ring is provided with a first rotating part and a first stationary part; and said second sleeve ring is provided with a second rotating part and a second stationary part.

9. The dumbbell according to claim 8, wherein said accommodating disk of each weight plate set of the plurality of weight plate sets is provided with a stationary through hole, and said accommodating disk is arranged on said first stationary part and said second stationary part through said stationary through hole, and said limiting disk is provided with a rotating through hole, and said limiting disk is arranged on said second rotating part and said first rotating part of an adjacent weight plate set of the plurality of weight plate sets through said rotating through hole; and when said dumbbell body rotates, said accommodating disk is stationary relative to said dumbbell body, and said limiting disk rotates synchronously with said dumbbell body.

10. The dumbbell according to claim 7, wherein each weight plate set of the plurality of weight plate sets is disposed adjacently to another weight plate set of the plurality of weight plate sets; each weight plate set of the plurality of weight plate sets is configured such that a first accommodating groove is arranged on said accommodating disk, and a limiting chamber is arranged in said first accommodating groove; a second accommodating groove and a third accommodating groove are arranged on said accommodating disk, and said limiting disk of the respective weight plate set is arranged in said third accommodating groove and said second accommodating groove of an adjacent weight plate set of the plurality of weight plate sets; and a fifth accommodating groove is also arranged on said accommodating disk, and said weight plate is arranged in said fifth accommodating groove; and wherein, each of two ends of said handle part are provided with a respective handle disk, and a sixth accommodating groove is arranged on each B of said respective handle disks; and said limiting disk in each said first-level weight plate set is arranged in said sixth accommodating groove of each of said respective handle disks.

11. The dumbbell according to claim 7, further comprising a base, wherein a base groove is arranged on said base, and said base groove can accommodate said dumbbell body and said weight plate set; and at least one unlocking block is arranged on said base groove, and a second locking mechanism is arranged on said first-level weight plate set, wherein said at least one unlocking block corresponds to said second locking mechanism arranged on said first-level weight plate set.

12. The dumbbell according to claim 11, wherein the second locking mechanism comprises a locking shell arranged on said accommodating disk of said first-level weight plate set, and a second locking block arranged on said locking shell a third elastic part is arranged on said locking shell, and said third elastic part pushes against said second locking block; and a third positioning post is arranged on said locking shell, and said third positioning post corresponds to said third elastic part; and a third positioning groove is arranged on said second locking block, and said third positioning groove corresponds to said third elastic part; and wherein, a locking groove and a locking opening are arranged on said accommodating disk of said first-level weight plate set, and said locking groove and said locking opening correspond to said second locking block; said second locking block is arranged in said locking groove and said locking shell, and said second locking block is provided with a locking protrusion; said limiting disk of said first-level weight plate set is provided with a locking tooth, and said locking tooth corresponds to said locking protrusion and said locking protrusion has a first position and a second position.

13. The dumbbell according to claim 6, wherein said limiting device of each weight plate set of said plurality of weight plate sets comprises a limiting chamber which comprises a limiting shell and a limiting cover, wherein said limiting cover corresponds to said limiting shell; and the at least one limiting block comprises a first limiting block and a second limiting block arranged in said limiting shell, and a first limiting opening and a second limiting opening are arranged on said limiting shell, wherein said first limiting opening corresponds to said first limiting block and said second limiting opening corresponds to said second limiting block.

14. The dumbbell according to claim 13, wherein a first elastic part and a second elastic part are arranged in said limiting chamber, wherein said first elastic part pushes against said first limiting block and said second elastic part pushes against said second limiting block.

15. The dumbbell according to claim 14, wherein said at least one limiting block and said at least one transmission block are arranged in said limiting chamber, wherein said at least one limiting block corresponds to said at least one said locking notch, and said at least one transmission block pushes against said at least one limiting block; and said at least one transmission block is provided with an abutting block, and said limiting chamber is provided with said at least one limiting opening and at least one abutting opening, wherein said at least one limiting opening corresponds to said at least one limiting block, said at least one abutting opening corresponds to said abutting block, and said abutting block is movably arranged in said limiting rail groove.

16. The dumbbell according to claim 15, wherein said at least one abutting opening is arranged on said limiting cover, and said at least one abutting opening corresponds to said abutting block; and said abutting block abuts against said limiting disk through said at least one abutting opening, and said abutting block is arranged in said limiting rail groove.

17. The dumbbell according to claim 16, wherein said at least one locking notch comprises a first locking notch and a second locking notch arranged on said accommodating disk, wherein said first locking notch corresponds to said first limiting opening and said second locking notch corresponds to said second limiting opening; and when said abutting block is located in said at least one locking block, said at least one transmission block pushes said first limiting block and said second limiting block out of said first limiting opening and said second limiting opening to be received and locked by said first locking notch and said second locking notch; and when said abutting block is located in said at least one opening block, said first elastic part and said second elastic part push against said first limiting block and said second limiting block, so that said first limiting block and said second limiting block are away from said first locking notch and said second locking notch.

* * * * *